US007106284B2

(12) United States Patent
Ohta et al.

(10) Patent No.: US 7,106,284 B2
(45) Date of Patent: Sep. 12, 2006

(54) LIQUID CRYSTAL DISPLAY DEVICE

(75) Inventors: Yoshihito Ohta, Okayama (JP); Takahiro Kobayashi, Okayama (JP); Katsuyuki Arimoto, Okayama (JP); Yoshinori Kobayashi, Takaraduka (JP); Seiji Kawaguchi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 503 days.

(21) Appl. No.: 10/481,749

(22) PCT Filed: Mar. 26, 2003

(86) PCT No.: PCT/JP03/03698

§ 371 (c)(1),
(2), (4) Date: Dec. 23, 2003

(87) PCT Pub. No.: WO03/083821

PCT Pub. Date: Oct. 9, 2003

(65) Prior Publication Data

US 2005/0024316 A1 Feb. 3, 2005

(30) Foreign Application Priority Data

Mar. 29, 2002 (JP) ..... 2002-096467

(51) Int. Cl.
*G09G 3/36* (2006.01)

(52) U.S. Cl. ..... 345/87; 345/204

(58) Field of Classification Search ..... 345/87–89, 345/90–96, 97–103, 204; 348/790
See application file for complete search history.

(56) References Cited

U.S. PATENT DOCUMENTS

| | | | | |
|---|---|---|---|---|
| 4,481,511 | A * | 11/1984 | Hanmura et al. | 345/100 |
| 5,298,913 | A * | 3/1994 | Numao et al. | 345/97 |
| 5,949,391 | A * | 9/1999 | Saishu et al. | 345/50 |
| 6,731,266 | B1 * | 5/2004 | Jung | 345/103 |
| 6,924,786 | B1 * | 8/2005 | Hebiguchi | 345/103 |
| 2001/0043168 | A1 * | 11/2001 | Koyama et al. | 345/52 |
| 2002/0041267 | A1 * | 4/2002 | Jung | 345/92 |

FOREIGN PATENT DOCUMENTS

EP 0478382 A2 * 4/1992

(Continued)

OTHER PUBLICATIONS

Journal of the Japanese Liquid Crystal Society (Nihon Ekisho Gakkaishi), Apr. 25, 1999 (vol. 3 No. 2), pp. 99(17)-106(24).

*Primary Examiner*—Nitin Patel
(74) *Attorney, Agent, or Firm*—Wenderoth, Lind & Ponack, L.L.P

(57) ABSTRACT

A liquid crystal display device includes a signal conversion part (101), a drive pulse generation part (102), a source driver (103), a gate driver (1704), and a multiplexer part (1706). In addition, between the source driver (103) and a display region part (1705) there is provided an intersection part (204) where, when source lines (S1, S2, S3, S4, . . . ) in the display region part are divided into groups each including four source lines, lines that correspond to two source lines (S2 and S3) located the second and third from an end in each group intersect each other. With the liquid crystal display device using the multiplexer part for switching a plurality of source lines in a time-sharing manner, the degradation of the display quality of pixels caused by, for example, an insufficient writing capability to the pixels is improved.

15 Claims, 23 Drawing Sheets

FOREIGN PATENT DOCUMENTS

| | | | |
|---|---|---|---|
| JP | 404245218 | * | 1/1991 |
| JP | 9-138421 | | 5/1997 |
| JP | 11-109921 | | 4/1999 |
| JP | 2001-281707 | | 10/2001 |

* cited by examiner

LIQUID CRYSTAL DISPLAY DEVICE

TECHNICAL FIELD

The present invention relates to an active matrix type liquid crystal display device, and in particular to a liquid crystal display device utilizing an OCB (Optically self-Compensated Birefringence) liquid crystal mode which provides a wide viewing angle and a fast response.

BACKGROUND ART

As is well known, liquid crystal display devices have been used in large numbers as the screen display devices for computer devices, for example. In coming years, the liquid crystal display device is expected to expand its range of TV applications. However, a TN (Twisted Nematic) mode, which is currently in wide use, has major display performance problems for use in a TV, such as a narrow viewing angle, an unsatisfactory response time, reduced contrast due to parallax, and blurring of a moving image.

In recent years, the studies on an OCB mode have been advanced in place of the aforementioned TN mode. The OCB has characteristics which provide for a wider viewing angle and a faster response compared to that of TN, and thus it can be said that the OCB is a display mode more suitable for displaying natural moving images.

A conventional liquid crystal display device is described below.

In a display region of a liquid crystal display device, as shown in FIG. 16, source lines 1601 (S1, S2, . . . ), gate lines 1602 (G1, G2, . . . ), and thin film transistors (hereinafter referred to as "TFTs") 1603, serving as switching elements, are provided. A drain electrode of each TFT is connected to a pixel electrode in a pixel 1604. Each pixel 1604 comprises a pixel electrode, a counter electrode, and liquid crystal sandwiched and held between those electrodes. A stray capacitance 1606 is present between the pixel electrode and the source line 1601. For example, the stray capacitance between a source line S2 and a pixel on the left side of the source line S2 is indicated as C2L and the stray capacitance between the source line S2 and a pixel on the right side of the source line S2 is indicated as C2R.

The counter electrode of each pixel 1604 is connected to a counter drive line 1605 and is driven by a counter voltage Vcom.

Next, with reference to FIG. 17, the configuration related to the driving of a conventional liquid crystal display device is described. This conventional liquid crystal display device comprises a signal conversion part 1701, a source driver 1703, a gate driver 1704, a drive pulse generation part 1702 for generating a pulse used for driving each driver, and a display region part 1705 of a liquid crystal panel whose configuration is illustrated in the aforementioned FIG. 16. The signal conversion part 1701 increases the speed of an input image signal by R times at every one horizontal period, R being obtained from R=(N+1)/N, where N is an integer equal to or greater than 1, and converts it to a display signal, which is the image signal whose speed has been increased by R times, and a non-display signal with an R-times speed.

From the signal conversion part 1701, the display signal and the non-display signal are sent to the source driver 1703. The source driver 1703 converts, in accordance with the control of a source driver control signal sent from the drive pulse generation part 1702, the polarity and voltage of the display and non-display signals to an appropriate polarity and voltage for each pixel, and then outputs them as a display signal voltage and a non-display signal voltage.

A multiplexer part 1706 is disposed between the source driver 1703 and the display region part 1705. The multiplexer part 1706 selectively supplies, under the control of a multiplexer control signal sent from the drive pulse generation part 1702, to a plurality of source lines 1601 the display signal voltage and the non-display signal voltage outputted from the source driver 1703 by switching between the source lines in a time-sharing manner.

The gate driver 1704 supplies, in accordance with the control of a gate driver control signal sent from the drive pulse generation part 1702, an ON or OFF potential of the TFT 1603 on the gate line 1602 in synchronization with the output of the display signal voltage or non-display signal voltage from the source driver 1703.

A power supply part 1707 supplies a voltage having a desired polarity and voltage value to each function block in the manner indicated by the dotted lines.

The voltage that is applied to both ends of a liquid crystal cell, such as the pixel 1604 in the display region part 1705, is a difference between the voltage Vcom to be supplied to the counter electrode and the aforementioned display signal voltage or non-display signal voltage to be applied to each pixel 1604 via the source line 1601 and the TFT 1603, and this determines the transmittance of each pixel 1604.

Furthermore, the polarity of the voltage to be applied to both ends of a liquid crystal cell is defined based on whether the difference between the above-described voltage Vcom and the above-described display signal voltage or non-display signal voltage to be applied to each pixel 1604 is positive or negative, and thus is not simply defined by the voltage polarity of the above-described display signal voltage or non-display signal voltage. However, in the following description, for simplicity of description, the polarity of the voltage applied to both ends of a liquid crystal cell will be referred to as the polarity of the above-described display signal voltage or non-display signal voltage.

Such a driving method is similarly employed in both an OCB cell and a TN-type cell. The OCB cell, however, requires a unique driving, which is not required for the TN-type cell, at a start-up stage where an image display is started. The OCB cell has a bend alignment with which an image display can be performed, and a splay alignment with which an image display cannot be performed. To shift from a splay alignment to a bend alignment (hereinafter referred to as a "transition"), a unique driving is required, such as a high-voltage application for a certain time. Note that the driving related to this transition is not directly related to the present invention, and thus any further description is not provided herein.

The OCB cell has a problem in that even if a bend-alignment transition is obtained once by the aforementioned unique driving, if a voltage with a predetermined level or greater is not applied for at least a certain time, the bend alignment cannot be maintained, resulting in a return to a splay alignment (this phenomenon is hereinafter called a "reverse transition").

To suppress the occurrence of a reverse transition, it is known that a high voltage may be applied periodically, as described in Japanese Laid-Open Patent Publication No. 11-109921 and Journal of the Japanese Liquid Crystal Society (Nihon Ekisho Gakkaishi), Apr. 25, 1999 (Vol. 3. No. 2), pp. 99(17)–106(24). This high potential corresponds to the above-described non-display signal voltage. By periodically applying this non-display signal voltage by the driving, as will be described later, the occurrence of a reverse transition can be suppressed. It is common practice to use the maximum voltage of the above-described display signal voltage, which corresponds to a black display, as this non-display signal voltage in view of the effect of suppressing the occurrence of a reverse transition and the display quality. The driving that a high potential is periodically applied to suppress a reverse transition is hereinafter called "CR (Cyclic Resetting) driving".

Typical potential-transmittance curves for OCB are illustrated in FIG. 18.

In FIG. 18, a curve 1801 is a potential-transmittance curve in the case where a predetermined potential for preventing a reverse transition is not inserted, and a curve 1802 is a potential-transmittance curve in the case of CR driving where a predetermined potential for preventing a reverse transition is inserted. A potential 1803 is a critical potential Vth at which a reverse transition from a bend alignment to a splay alignment occurs in the case where a reverse transition is not prevented. A potential 1804 is a potential (white potential) when the transmittance is maximum, and a potential 1805 is a potential (black potential) when the transmittance is minimum. In the case where a reverse transition is not prevented, if the potential is Vth or lower, the alignment returns to a splay alignment, and thus an appropriate transmittance cannot be obtained. Therefore, driving with a potential of Vth or higher is required. In this case, however, as shown in the figure, the transmittance that corresponds to the potential 1803 is the maximum transmittance, and therefore a sufficient luminance cannot be obtained.

Liquid crystals represented by OCB and TN require so-called alternating-current driving. However, any specific configuration of such driving is not described in either the aforementioned Japanese Laid-Open Patent Publication No. 11-109921 or Journal of the Japanese Liquid Crystal Society, and thus what sort of alternating-current reversal should be performed cannot be identified from these references. Hence, as a conventional example, the CR driving performed by a combination of a line-by-line reversal and a frame-by-frame reversal, which is the most typical driving in a liquid crystal display device, is described with reference to FIGS. 19, 20, and 22.

FIG. 19 shows the configuration of the source driver 1703, the display region part 1705, and the multiplexer part 1706 of a conventional liquid crystal display device, shown in the aforementioned FIG. 17. Note that a group of source lines is indicated as "1901" and a group of gate lines is indicated as "1902".

For simplicity, FIG. 19 shows a portion that corresponds to the upper left portion of the multiplexer part 1706, including four source lines and eight gate lines, two outputs indicated by ST1 and ST2 as the output terminals of the source driver 1703, and switching elements in the multiplexer part 1706 only for the four source lines. For the remainder, the same configuration as above is repeated, and thus the illustration thereof is omitted.

As for the display region part 1705, "R", "G", and "B" shown in the pixels indicate color attributes of the pixels, the ensuing number indicates the row number (i.e., the row number of the gate lines) in the display region, and "+" or "−" indicates the voltage polarity that the liquid crystal cell holds in a given one screen.

Reference numeral 1903 indicate multiplexer control signals denoted as CTL0 and CTL1 respectively, and each signal is connected to the gate of each switching element in the multiplexer part 1706, as shown in the figure. The switching element in the multiplexer part 1706 is indicated by a two-digit number following "MP", and the first digit indicates the control signal number and the second digit indicates the number of the source line to which the switching element is connected. In addition, the source and drain of each switching element in the multiplexer part 1706 are connected to the source driver 1703 and a source line, respectively. Each of the outputs ST1 and ST2 of the source driver 1703 is divided in two, and is connected to adjacent source lines via the multiplexer part 1706.

FIG. 20 is a timing diagram illustrating the control performed by a conventional liquid crystal display device. Here, an exemplary operation in the case where N=4 is described. In the figure, SP1 and SP2 are a type of a source driver control signal and are control signals for controlling the polarity of the output voltage of the source driver 1703. In the HIGH period of SP1, the aforementioned display signal voltage or non-display signal voltage, in which ST1 has a positive polarity and ST2 has a negative polarity, is outputted. In the LOW period, a display signal voltage or non-display signal voltage, in which ST1 has a negative polarity and ST2 has a positive polarity, is outputted. SQ1 and SQ2 indicate the type and polarity of the output voltages of ST1 and ST2 of the source driver 1703 which are respectively controlled by the aforementioned SP1 and SP2. Here, "K" indicates the aforementioned non-display signal voltage, "R", "G", and "B" indicate the aforementioned display signal voltages each having a display color attribute, and "+" and "−" indicate the polarity of each voltage. The non-display signal voltage, indicated by "K", indicates the output voltage of the source driver 1703 with respect to a non-image signal that is inserted in the display signal voltage at a rate conversion of R=5/4=1.25 times speed in the signal conversion part 1701.

The "SWP" is another type of a source driver control signal, and is a signal for controlling the output timing of the source driver 1703. By the rise and fall of the SWP's HIGH and LOW logic (indicated by arrows in the figure), the source driver begins to produce an output.

In the HIGH period of CTL0, the switching elements MP10 and MP40 in the multiplexer part 1706 connected to the source lines S1 and S4, respectively, are electrically conducted, and consequently the output of ST1 is supplied to S1 and the output of ST2 is supplied to S4. Then, in the LOW period of CTL0, these supplies are interrupted. Similarly, in the HIGH period of CTL1, the switching elements MP21 and MP31 in the multiplexer part 1706 connected to the source lines S2 and S3, respectively, are electrically conducted, and consequently the output of ST1 is supplied to S2 and the output of ST2 is supplied to S3. Then, in the LOW period of CTL1, these supplies are interrupted.

S1P, S2P, etc., indicate the states of the potentials of the source lines, such as S1 and S2, resulting from the application of the aforementioned display signal voltage and non-display signal voltage to the source lines by the above-described signal voltage control. The symbols "K", "R", "G", "B", "+" and "−" mean the same as those described for SQ1 and SQ2. Note that the number following "K", "R", "G", or "B" indicates the row number of the gate lines.

T01 to T10 indicate one period (one cycle) of R-times speed driving in the case where N=4. When one horizontal period of an input image signal is indicated as 1H, the length of each period is equivalent to NH/(N+1), and 10 cycles are equivalent to 8H.

As for the flow of a signal voltage, for example, the non-display signal voltage of K+ of SQ1 present in the former part of the T01 period is outputted at the time of the rise of SWP at the beginning of this period, and then applied to the electric capacitances (all capacitances belonging to S1, such as, for example, the TFT 1603 and the stray capacitance 1606) of the source line S1 via the switching element MP10 in the multiplexer part 1706 which is electrically conducted while CTL0 is HIGH, whereby S1P takes a non-display signal voltage of the symbol "K+". In the latter part of T01, CTL0 becomes LOW and thus the switching element MP10 in the multiplexer part 1706 on the source line S1 is interrupted, whereby the non-display signal voltage of K+ remains on the source line S1 until the end of the T01 period. In the subsequent former part of the T02 period, the display signal voltage of R+ of SQ1 is applied to the source line S1 in a similar process, and the display signal voltage of R+ remains on the source line S1 until the end of the T02 period. Concurrently, during the period from the latter part of T01 to the former part of T03, the non-display signal voltage of K− on SQ1 and the subsequent display signal voltage of G− are each outputted at the time of the fall of SWP and applied to the source line S2, whereby these voltages each remain on the source line S2 for a predetermined period. Following this, the potential changes in the source lines S1 and S2 are repeated in a similar process for one cycle starting T01 and ending T10. The states of SQ2, S3P, and S4P are similar to the above.

The group of gate lines 1902, shown in FIG. 19, is driven by gate-line drive pulses which are generated by the gate driver 1704 upon receipt of gate driver control signals from the drive pulse generation part 1702. That is, the gate line drive pulses G1P, G2P, . . . , such as those shown in FIG. 21, are applied to the gate lines G1, G2, . . . , respectively. In the period when the ON potential of, for example, the pixel TFT 1603 is exceeded (e.g., the period of TKW and the subsequent high-potential period, shown in FIG. 21), the TFT 1603 of a corresponding pixel 1604 turns to an ON state, and the charging of the source line potential, shown in FIG. 20, (hereinafter referred to as "writing") is performed on the liquid crystal cell.

Here, an example of conventional driving is such that four gate lines G1 to G4 are simultaneously selected in the aforementioned TKW period (i.e., the period which lies 2KNH before T01, shown in FIG. 20, where K is a positive integer and N is 4 in this example), and a non-display signal voltage is written to all pixels on the gate lines G1 to G4. Further, in the time within 4H after a predetermined period {(2K−1)NH}, the display signal voltages of R, G, and B are sequentially written to the pixel cells on each of the gate lines G1 to G4. The subsequent four gate lines G5 to G8 repeat a similar operation after a 4H delay from the gate lines G1 to G4. At this point, the polarity of the potential of the source line is reversed, as shown in FIG. 20. This operation is performed over all gate lines and completed in one frame. As described above, all gate lines in the display region part 1705 are selected twice in one frame period, and a display signal voltage and a non-display signal voltage are each written to the pixels on each gate line once.

In the subsequent frame, in order to reverse the polarity of the pixel voltage, the phases of SP1 and SP2 are shifted 180 degrees. This is the CR driving method, described as a conventional example, which employs a one-column reversal, a four-line reversal, and a frame reversal.

For the control and output operation methods of the source driver, many known modes are available, but such methods are not directly related to the present invention. The same is true of the settings of the aforementioned TKW and the invariable K, which are gate drive conditions, and the setting of N for an R-times speed, a detailed operation, etc. Therefore, any further description thereof is not provided herein.

The display signal voltage and non-display signal voltage can be periodically written by the above-described operation. By appropriately providing the voltage of this non-display signal voltage, a reverse transition of an OCB liquid crystal cell can be prevented.

The above-described driving, however, is associated with the following problems resulting from the fact that the time the non-display signal voltage is applied to the source line from the source driver 1703 is split into the former and latter parts in each period of T01 or T06, or a period which exists 2KNH therebefore or thereafter, and resulting from the open state of the source line occurred during the interruption period of the multiplexer part 1706. The problems are described below with reference to FIGS. 22 and 23.

(a) of FIG. 22 illustrates the transitional state of the potential changes in source lines. The symbols shown in the figure. are the same as those shown in FIG. 20. For example, looking at SQ1, S1P, and S2P in the period T01, when K+ on SQ1 is applied to the source line S1 in the former part of T01, a potential change occurs in S1P in the forward direction (in the figure, the potential change in the forward direction is indicated by an upward arrow).

When K− on SQ1 is applied to the source line S2 in the latter part of T01, a potential change occurs in S2P in the reverse direction (in the figure, the potential change in the reverse direction is indicated by a downward arrow). In the period T06, those potential changes occur in the opposite directions to the above. Similar potential changes occur in SQ2, S3P, and S4P. In practice, even in other periods, potential changes occur resulting from the application of the display signal voltages of R, G, and B to each source line. However, as described above, the voltage value of the display signal voltage is equal to or lower than that of the non-display signal voltage, and changes in a slight degree in accordance with the content of a pixel signal, and thus the influence of such changes is small. Therefore, for simplicity of description, such an influence is not taken into consideration here.

Adjacent source lines are electrically coupled to each other by capacitances connected in series with each other with a TFT drain electrode disposed therebetween, such as, for example, a pair of C1R and C2L and a pair of C2R and C3L, shown in FIG. 16. In addition, each pixel is electrically coupled, by these stray capacitances, to source lines present on both sides of the pixel.

Therefore, the potential change in a source line may possibly exert a comparatively great influence on pixels present on the sides of the source line or on source lines present on the sides of the source line.

The OFF pixel in (b) of FIG. 22 is a pixel to which a display signal voltage or a non-display signal voltage has been written, but the subsequent display signal voltage or non-display signal voltage has not been written. In other words, the OFF pixel is a pixel in which the TFT 1603 is in an OFF state.

As shown in (b1) of FIG. 22, the change of K− in S2P in the latter part of T01 exerts as influence in the reverse direction on all OFF pixels present between the source lines S1 and S2.

In the figure, this is indicated as "influence on OFF pixels", and the polarity of such an influence is indicated by an arrow. In addition, in this period, the source line S1 is in an open state with respect to the multiplexer part 1706. Therefore, the source line S1 which is in an open state in this period receives a similar influence in the reverse direction from the aforementioned OFF pixel. In the figure, this is indicated as "influence on potentials of former open source lines", and the polarity of such an influence is indicated by an arrow. Similarly, the change of K+ in S3P in the latter part of T01 exerts the influence in the forward direction on all OFF pixels present between the source lines S3 and S4, and also exerts the influence in the forward direction on the source line S4 which is in an open state in this period. As for the OFF pixels present between the source lines S2 and S3, because S2P and S3P cause changes in directions opposite to each other, these influences counteract each other, and thus if C2R≈C3L, the influences on these OFF pixels are small. In the figure, a small influence on the OFF pixel is indicated by a black square. As for the OFF pixels present between the source lines S4 and S5, because there are no changes in S4P and S5P, no influence is exerted on the OFF pixels, and thus no particular symbol is provided in the figure.

Although the changes which occurred in the source lines S1 and S4 are superimposed on the write voltages of display signal voltages in the subsequent periods T02 to T05, their polarities are opposite to that of the display signal voltages written thereto, and thus the degree of the influence is evaluated as "−1" and the evaluation rating is provided in (b1) of FIG. 22.

The change of K+ in S1P and the change of K− in S4P in the former part of T01 exert an influence on the source lines S2 and S3 which are in an open state in this period, but immediately after this, the non-display signal voltages of K− and K+ are supplied to the source lines S2 and S3, and therefore such an influence is eliminated at this point and no influence is exerted on the writing of a display signal voltage in any period after T02. Thus, the evaluation ratings to the source lines S2 and S3 in (b1) of FIG. 22 result in "0".

The pixels to which a display signal voltage have been written in T02 remain as OFF pixels after T03 until a non-display signal voltage is written in the next frame. The influence exerted on these pixels from source lines in the meantime is discussed now. Note that such an influence is a repetition of the influence of the periods D to F, shown in FIG. 22, and therefore the degree of the influence is evaluated in these periods.

(b2) of FIG. 22 schematically illustrates the changes in the source lines S1 to S4 caused by the non-display signal voltage during the periods D to F. As shown in the figure, no influence is exerted on the OFF pixels on average during these periods, and thus the evaluation ratings to the source lines S1 to S4 result in "0".

The influence on the pixels for one frame resulting from the writing of a non-display signal voltage is expressed as a sum of the evaluation ratings indicated in (b1) of FIG. 22 and (b2) of FIG. 22. That is, as shown in (b3) of FIG. 22, it can be seen that in the pixels on a source line Sj, which corresponds to j=4i−3 or j=4i, where i=1, 2, 3 . . . , the transmittance becomes higher than the originally intended value (i.e., the luminance is increased). FIG. 23 is a schematic diagram illustrating display images. (a) of FIG. 23 shows the example where the pixels of R, G, and B are operated at an original constant luminance. In this case, an image is obtained which has no display non-uniformity when viewed from an appropriate visual distance, such as that shown in (b) of FIG. 23. In the aforementioned conventional example, however, as the result of an influence such as that shown in (b3) of FIG. 22, the actual image shown in (c1) of FIG. 23 is obtained, based on which a visual image, such as that shown in (c2) of FIG. 23, is obtained. That is, in a conventional example, there is a problem in that vertical lines, such as those shown in (c2) of FIG. 23, are visually recognized by a viewer.

Moreover, in the case of column reverse driving of a conventional example, a voltage range of K+ to K− is required for the source line voltage, and the maximum value of the display signal voltage is equal to or substantially equal to the non-display signal voltage. Therefore, for example, when SQ1 changes from K+ to K− in the period T01 in FIG. 20, or when SQ1 changes from K− to R+ between the periods T01 and T02, an output capability (i.e., slew rate) which is sufficiently great to support short cycles of SP1 and SP2 is required. For this reason, in a conventional case, the charging capability of the source line, i.e., the pixel writing capability, is insufficient sometimes, thereby causing degradation of the display quality of an image.

Stated otherwise, conventionally, an extremely high-cost source driver is required.

Furthermore, a reverse transition in liquid crystal cells of R, G, and B must be prevented with one type of non-display signal for CR driving, and thus there is a limit to the improvement in display quality.

In particular, because recent liquid crystal panels are increased in size and have higher definition, the number of source lines and the number of pixels are increased and stray capacitances are increased because the source line and the pixel become closer to each other. Thus, there is a tendency to worsen the aforementioned interference problem and to cause an insufficient charging time of pixels.

Accordingly, an object of the present invention is to provide a liquid crystal display device capable of displaying high-quality images, by solving the foregoing problems.

DISCLOSURE OF THE INVENTION

To achieve the above object, the present invention has the following aspects. It is to be understood that reference numerals, etc., in parentheses are provided, for the purpose of helping to understand the present invention, to show the corresponding relationship with embodiments, as will be described later, and thus are not intended to limit the scope of the present invention.

A liquid crystal display device of the present invention includes a liquid crystal panel with a display region part (1705) composed of a plurality of source lines (S1, S2, . . . ), a plurality of gate lines (G1, G2, . . . ), and pixel cells (1604) arranged in a matrix at intersections between the source lines and the gate lines. The device comprises: a signal conversion part (101); a drive pulse generation part (102); a source driver (103); agate driver (1704); a multiplexer part (1706); and an intersection part (204) where, when the source lines in the display region part are divided into groups of four, lines that correspond to two source lines located the second and third from an end in each group intersect each other, the intersection part being present between the source driver and the display region part. The signal conversion part converts an input image signal at a horizontal rate, generates a non-display signal during a slack time created by the conversion, and inserts the non-display signal in a display signal, which is the converted input image signal. The drive pulse generation part generates various control pulses (SP1, SP2, SWP, CTL0, and CTL1) from an inputted synchronous signal. The source driver receives various signals from the signal conversion part and the drive pulse generation part, converts the display signal and the non-display signal to predetermined voltage values, and outputs them as a display signal voltage (R, B, or G) and a non-display signal voltage (K), respectively. The gate driver receives a control signal from the drive pulse generation part and supplies a drive voltage to the gate lines (see FIG. 21). The multiplexer part supplies to a plurality of the source lines the display signal voltage and the non-display signal voltage from the source driver while switching the source lines in a time-sharing manner, the multiplexer part being disposed between the source driver and the display region part.

In the above-described liquid crystal display device, the display signal voltages (R, G, and B) which respectively correspond to a plurality of rows of the pixels may be sequentially applied to the respective source lines, within a predetermined period (T02 to T05) after the non-display signal voltage (K) has been applied to all of the source lines (see FIG. 3).

In the above-described liquid crystal display device, a polarity of the non-display signal voltage (K) (the polarity of a predetermined reference potential) supplied to the source line may be the same as a polarity of the display signal voltage (R, G, or B) (the polarity of the predetermined reference potential) supplied to the source line subsequent to the non-display signal voltage (see FIG. 3).

In the above-described liquid crystal display device, a polarity of the non-display signal voltage (K) (the polarity of a predetermined reference potential) supplied to the source line during a simultaneous selection period, in which a plurality of the gate lines are selected, may be the same as a polarity of the display signal voltage (R, G, or B) (the polarity of the predetermined reference potential) supplied to the source line subsequent to the non-display signal voltage, and polarities of the non-display signal voltage (K) may be opposite (K+ and K−) to each other between the source lines adjacent to each other (see FIG. 3).

The above-described liquid crystal display device may further comprise, between the multiplexer part (1706) and the display region part (1705), compensating voltage application means (806) for applying a compensating voltage (black) to the source lines, wherein the compensating voltage application means may apply the compensating voltage to all the source lines within a predetermined period (T01) in synchronization with the display signal voltage (R, G, or B) outputted from the source driver (703) (see FIG. 9).

In the above-described liquid crystal display device, the display signal voltages (R, G, and B) which respectively correspond to a plurality of rows of the pixels may be sequentially applied to the respective source lines, within a predetermined period (T02 to T05) after the compensating voltage (black) has been applied to all of the source lines (see FIG. 9).

In the above-described liquid crystal display device, a polarity of the compensating voltage (black) (the polarity of a predetermined reference potential) supplied to the source line may be the same as a polarity of the display signal voltage (R, G, or B) (the polarity of the predetermined reference potential) supplied to the source line subsequent to the compensating voltage (see FIG. 9).

In the above-described liquid crystal display device, a polarity of the compensating voltage (black) (the polarity of a predetermined reference potential) supplied to the source line during a simultaneous selection period, in which a plurality of the gate lines are selected, may be the same as a polarity of the display signal voltage (R, G, or B) (the polarity of the predetermined reference potential) supplied to the source line subsequent to the compensating voltage, and polarities of the compensating voltage (black) may be opposite (black+ and black−) to each other between the source lines adjacent to each other (see FIG. 9).

In the above-described liquid crystal display device, the compensating voltage application means (1306) may apply to the source lines two or more different types of compensating voltages (1308) having different voltage values.

In the above-described liquid crystal display device, the voltage values of the compensating voltages (black) may be adjustable in accordance with characteristics of the liquid crystal panel.

In the above-described liquid crystal display device, the source lines may correspond to any one of the colors R, G, and B, and the compensating voltage application means may supply to the source lines the compensating voltages (R black, G black, and B black) having voltage values which are individually set in accordance with the colors (see FIG. 13).

In the above-described liquid crystal display device, an absolute value of the compensating voltage (black) may be greater than an absolute value of the non-display signal voltage (K).

In the above-described liquid crystal display device, in a period (T01) in which the compensating voltage (black) is simultaneously applied to all the source lines, the non-display signal voltage (K) having the same polarity as that of the display signal voltages (R, G, and B) to be supplied to the source lines subsequent to the compensating voltage may be applied to the multiplexer part (1706) (see (b) of FIG. 15).

In the above-described liquid crystal display device, the intersection part (204) may be present between the source driver (103) and the multiplexer part (1706) (see FIG. 2).

In the above-described liquid crystal display device, a liquid crystal cell may be of OCB.

BEST MODE FOR CARRYING OUT THE INVENTION (First Embodiment)

Figure 1:
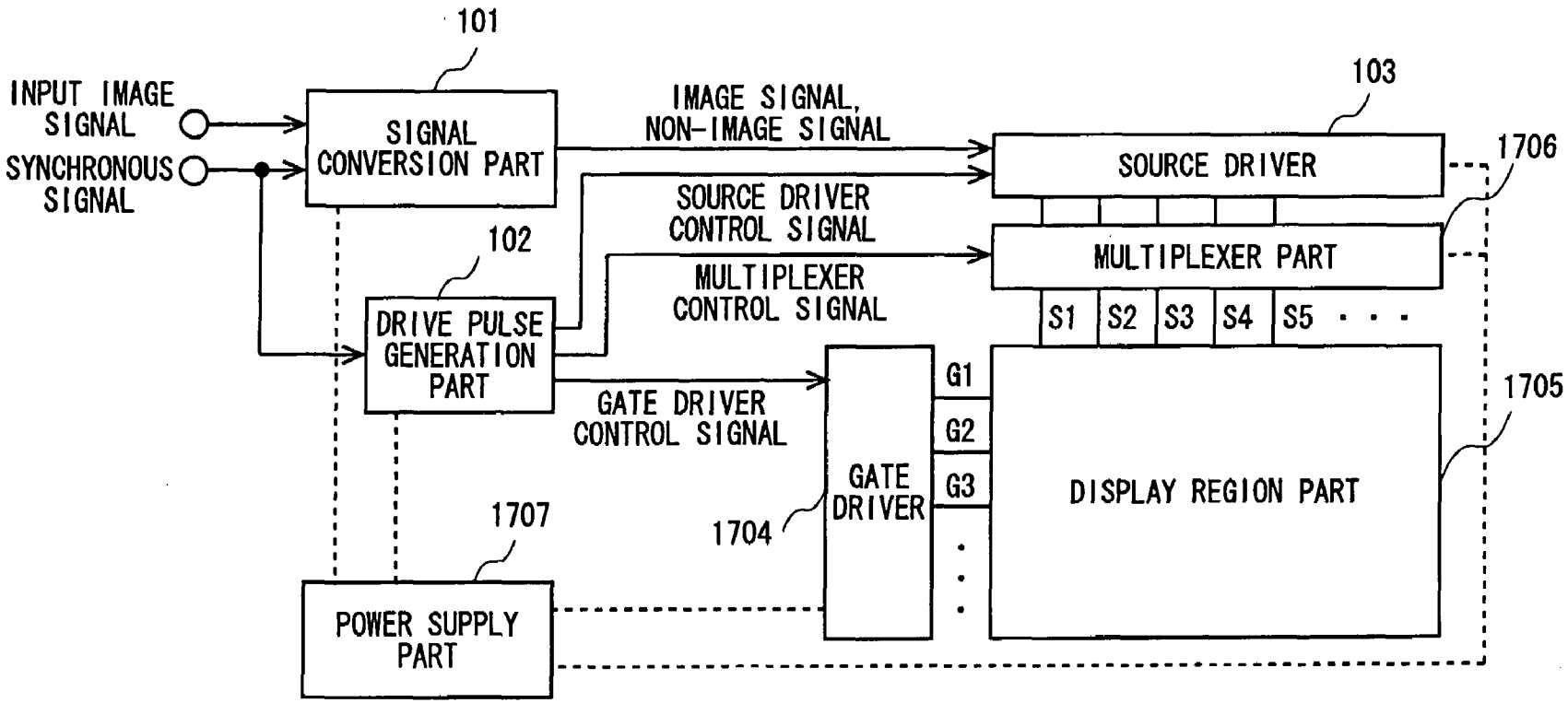
FIG. 1 is a diagram showing the configuration of a liquid crystal display device according to first, second, and third embodiments of the present invention.
Figure 2:
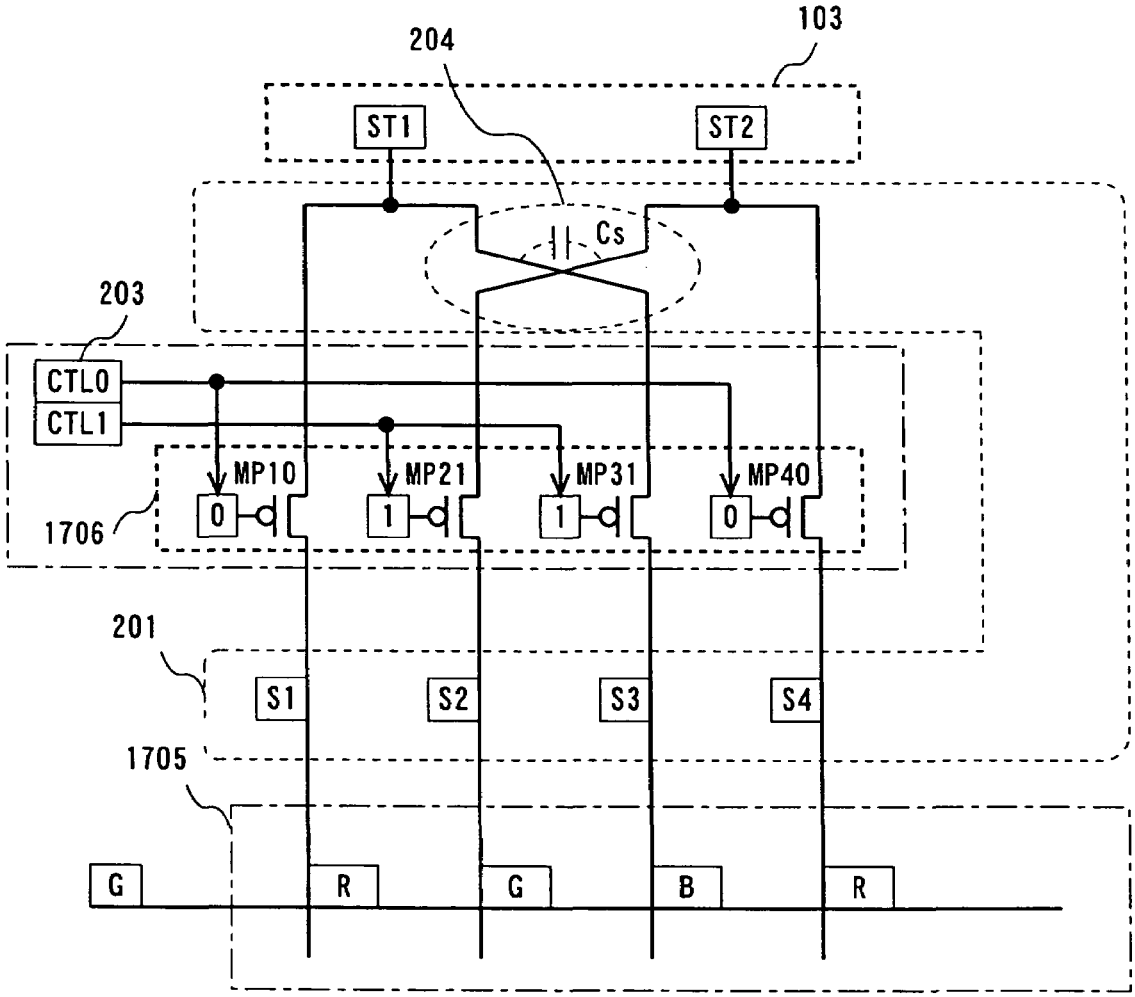
FIG. 2 is a diagram showing a part of the configuration of the liquid crystal display device according to the first and second embodiments of the present invention.
Figure 3:
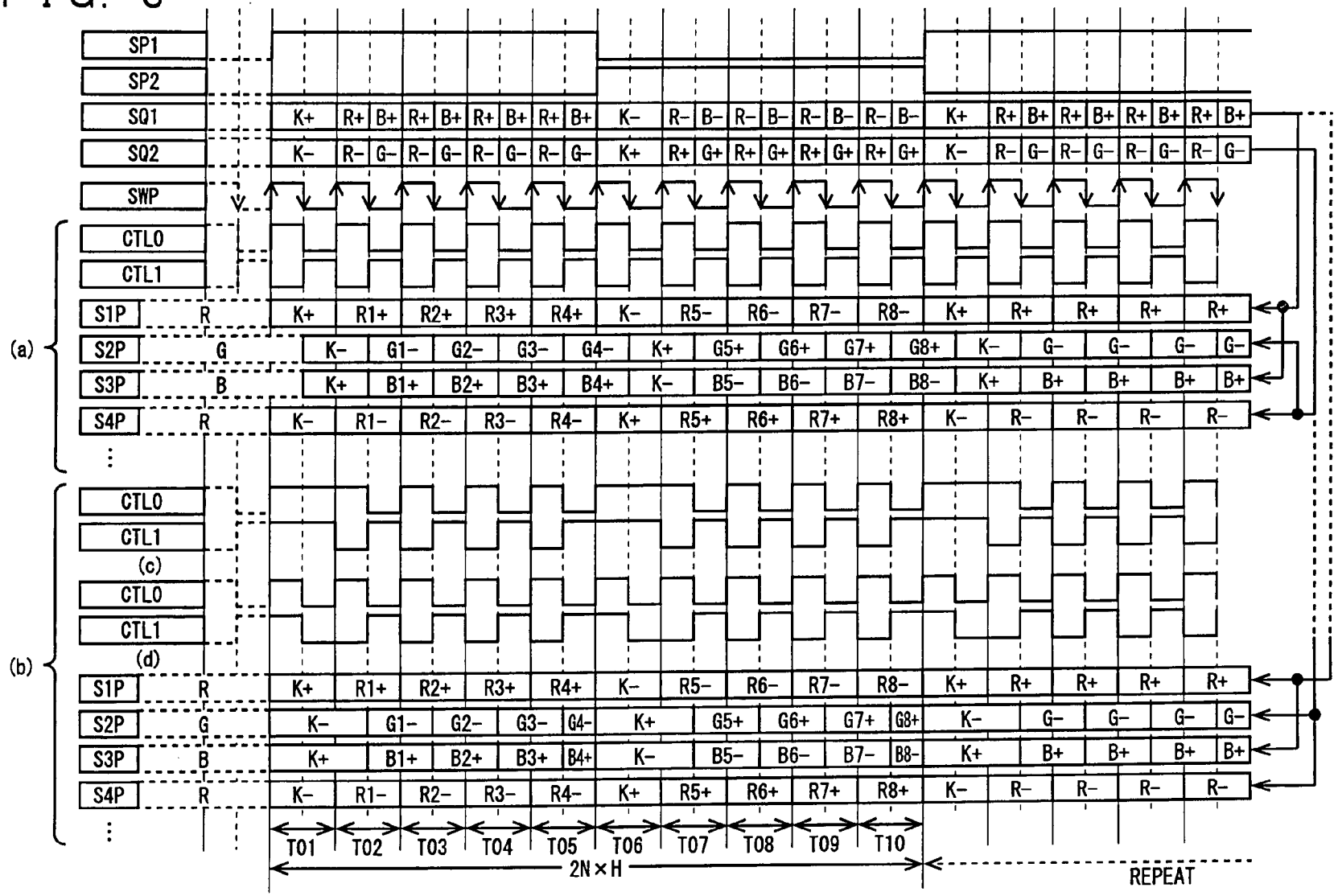
FIG. 3 is a timing diagram illustrating control performed by the liquid crystal display device according to the first, second, and third embodiments of the present invention.
Figure 4:
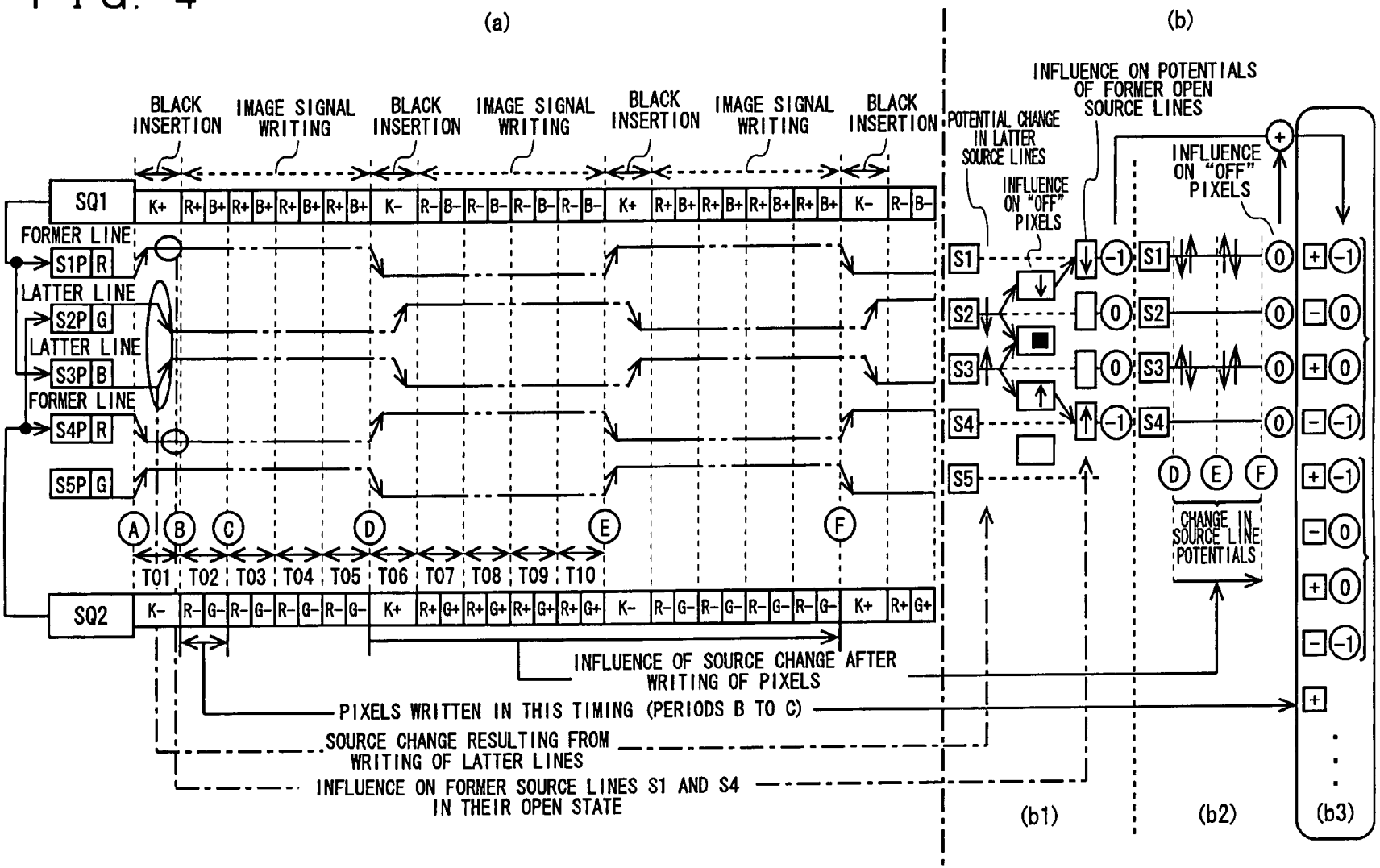
FIG. 4 is a timing diagram illustrating events occurring as a result of control performed by the liquid crystal display device according to the first embodiment of the present invention.

FIG. 1 is a diagram showing the configuration of a liquid crystal display device according to the first embodiment of the present invention, FIG. 2 is a diagram showing a part of the configuration, FIG. 3 is a diagram illustrating timing, and FIG. 4 is a timing diagram illustrating events occurring as a result of control by a driving method.

With reference to FIGS. 1 to 4, the driving of the liquid crystal display device is described below.

Figure 17:
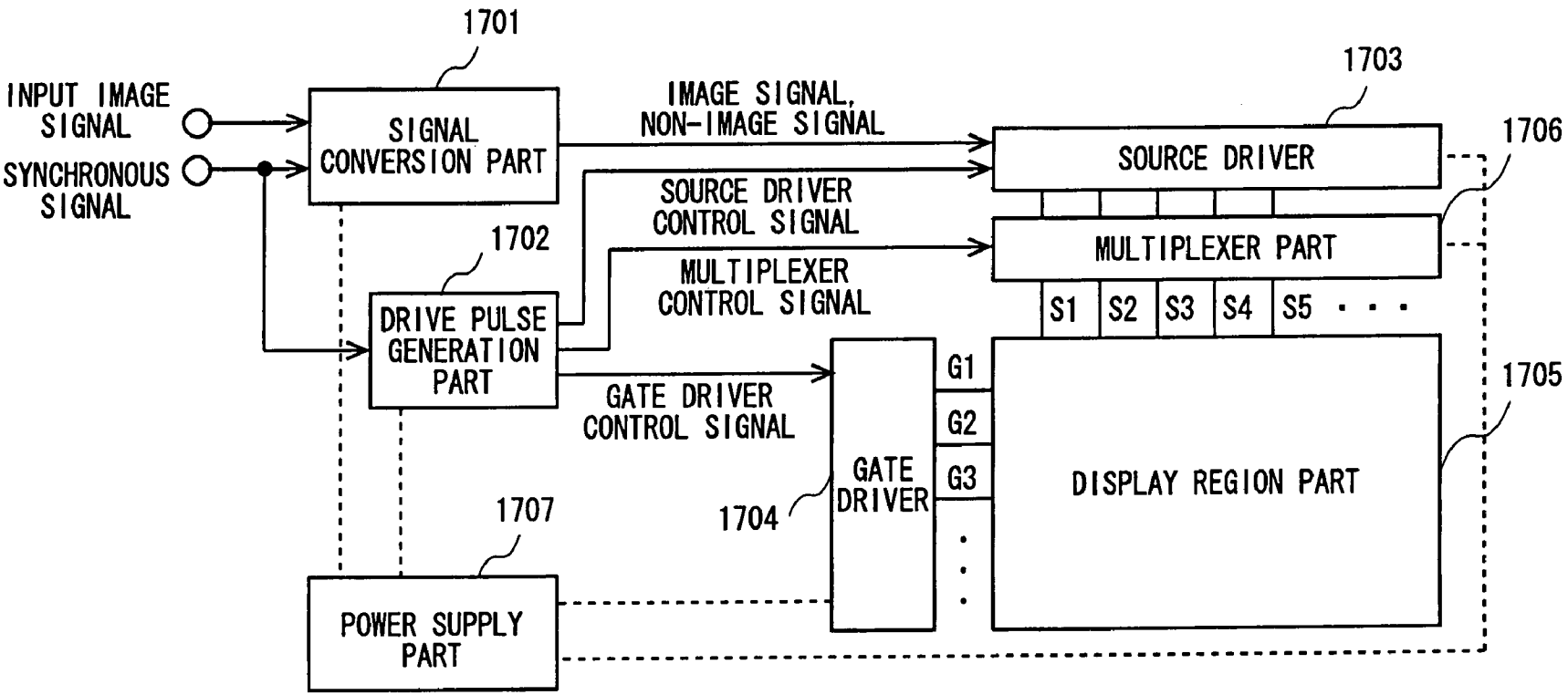
FIG. 17 is a diagram showing the configuration of a conventional liquid crystal display device.

The configuration of a liquid crystal display device according to the first embodiment is such that in a conventional liquid crystal display device, shown in FIG. 17, the signal conversion part 1701, the drive pulse generation part 1702, and the source driver 1703 are respectively replaced with a signal conversion part 101, a drive pulse generation part 102, and a source driver 103. Otherwise, all other elements are equivalent, and thus like reference numerals are used to indicate like elements and the descriptions thereof are omitted.

Figure 19:
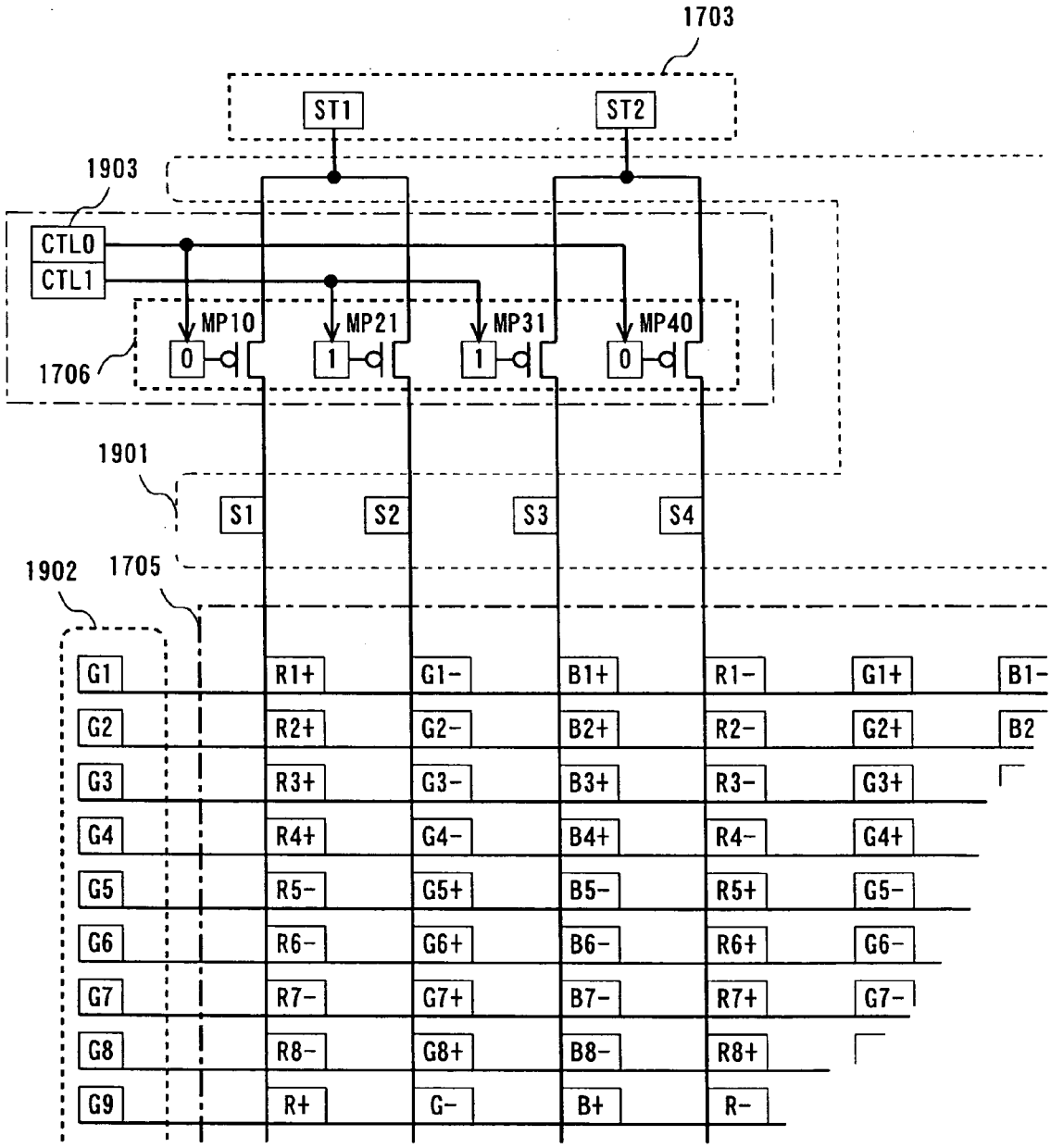
FIG. 19 is a diagram showing a part of the configuration of the conventional liquid crystal display device.

FIG. 2 shows some of the elements shown in the aforementioned FIG. 1, i.e., a source driver 103, a display region part 1705, and a multiplexer part 1706. Note that a group of source lines is indicated as "201" and multiplexer control signals are indicated as "203". In addition, the inside of the display region part 1705 is simplified compared to FIG. 19. In the present embodiment, a source line intersection part 204, where source lines S2 and S3 intersect each other, is provided in an area between the source driver 103 and the multiplexer part 1706, constituting a part of the group of source lines 201. Thus, unlike a conventional case, ST1 supplies a signal voltage to source lines S1 and S3 and ST2 supplies a signal voltage to source lines S2 and S4.

The control and operation of the present embodiment are described below with reference to FIG. 3.

The symbols used in FIG. 3 are the same as those used for the conventional example.

Figure 20:
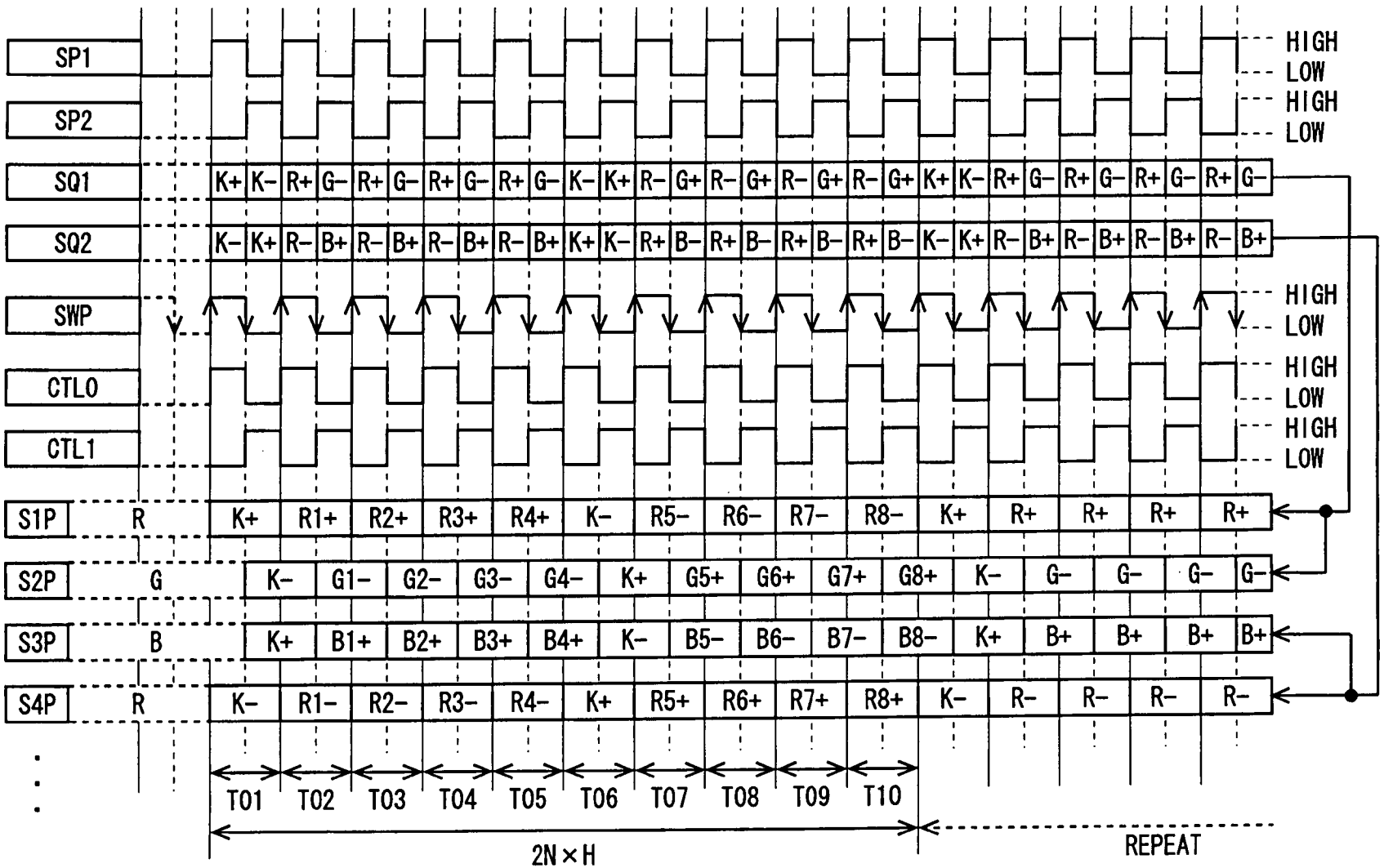
FIG. 20 is a timing diagram illustrating control performed by the conventional liquid crystal display device.
Figure 21:
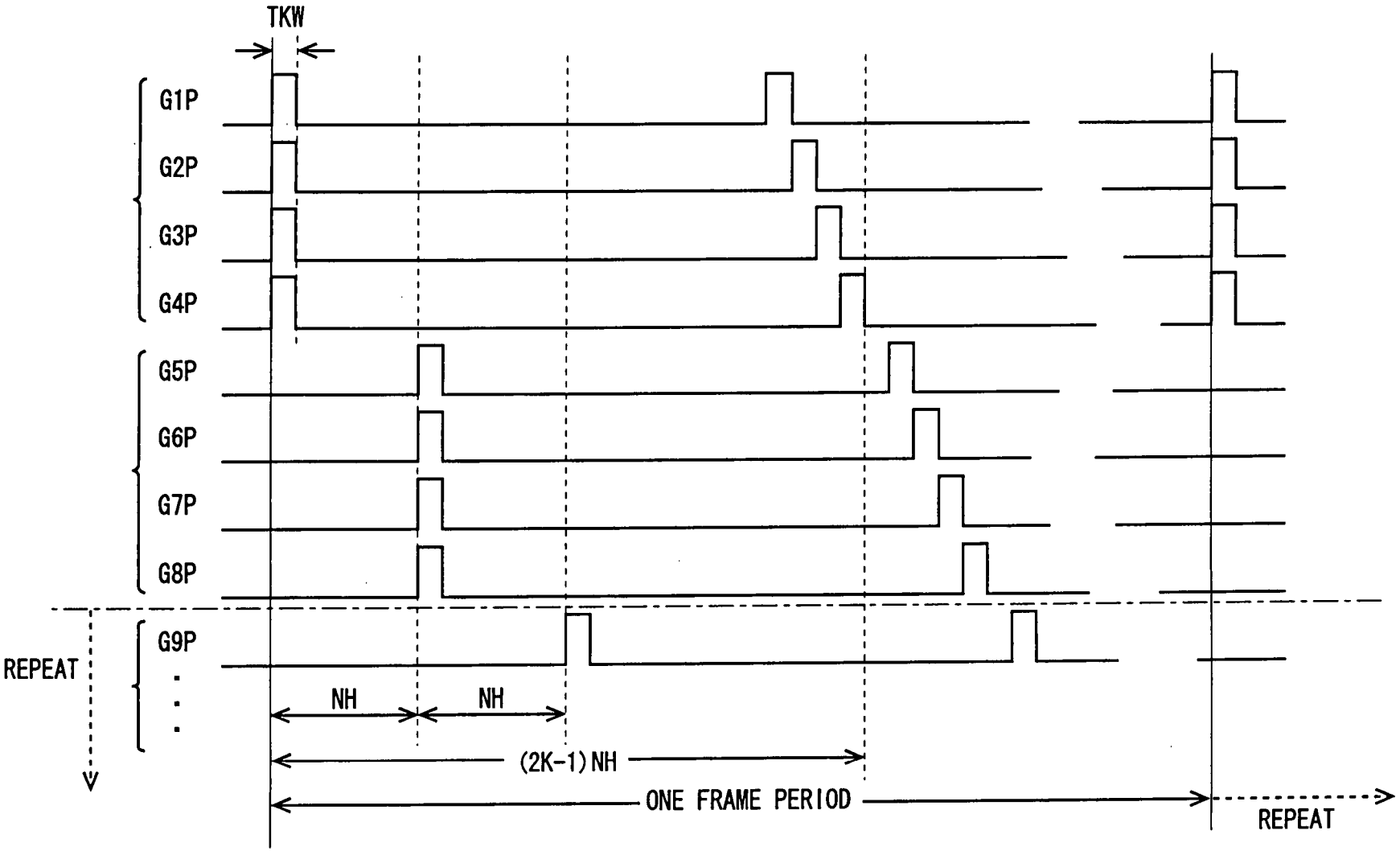
FIG. 21 is a diagram illustrating a driving method of gate lines.

As shown in FIG. 3, in the present embodiment, the signal outputs G and B of ST1 and ST2 are reversed from the conventional example, shown in FIG. 20. Such an operation is known and signal outputs can be easily changed by an RGB output selection function of the source driver, and thus the detailed description thereof is omitted. In addition, in the present embodiment, the repetition cycle of SP1 and SP2, which are output voltage polarity control signals of the source driver 103, is reduced to one tenth of the conventional example, whereby the output polarity of the source driver 103 becomes constant during the periods of T01 to T05 and the periods of T06 to T10.

(a) of FIG. 3 is a timing diagram according to the first embodiment. This (a) of FIG. 3 shows that by performing a control operation similar to that of the conventional example, which is already described, the same results as those obtained by the conventional example can be obtained for SP1 to SP4.

Figure 22:
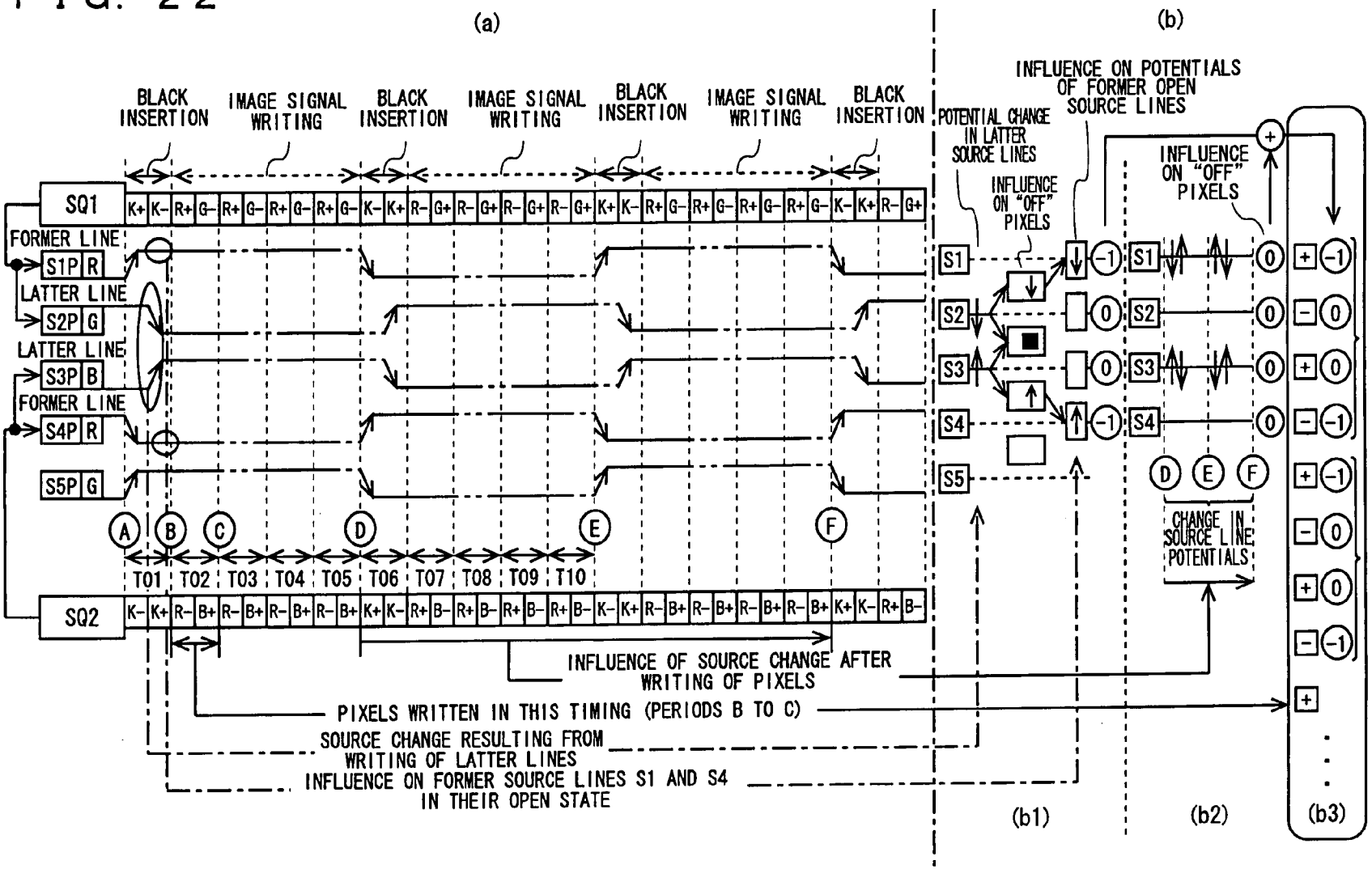
FIG. 22 is a diagram illustrating events occurring as a result of control performed by the conventional liquid crystal display device.

The changes in the source lines and the influence on OFF pixels in the above case are described in FIG. 4. The results shown in (b1), (b2), and (b3) of FIG. 4 are the same as those shown in (b1), (b2), and (b3) of FIG. 22 of the conventional example.

As described above, according to a liquid crystal display device of the first embodiment, it is not necessary to frequently change the output polarity of the source driver, and thus the writing of a display signal voltage can be performed quickly and image degradation due to a reduced image signal write time can be avoided. In addition, the writing of image signals is made easier, thereby providing an effect in that the output capabilities (e.g., slew rate, etc.) required for the source driver are reduced.

(Second Embodiment)

The configuration of a liquid crystal display device according to the second embodiment of the present invention is the same as that of the first embodiment, shown in FIGS. 1 and 2, and therefore the description thereof is omitted. The control and operation according to the second embodiment of the present invention are described below with reference to (b) of FIG. 3. The present embodiment is different from the first embodiment in the pulse waveforms of multiplexer control signals CTL0 and CTL1. Both CTL0 and CTL1 shown in (c) of FIG. 3 are always "HIGH" in the periods of T01 and T06 in a 2NH cycle. Such pulse signals can be easily generated by logically ORing CTL0 and a control pulse for inserting a non-display signal voltage, which is generated in the signal conversion part 101, shown in (a) of FIG. 3. As this generation method is not directly related to the present invention, any further description thereof is not provided herein.

Figure 5:
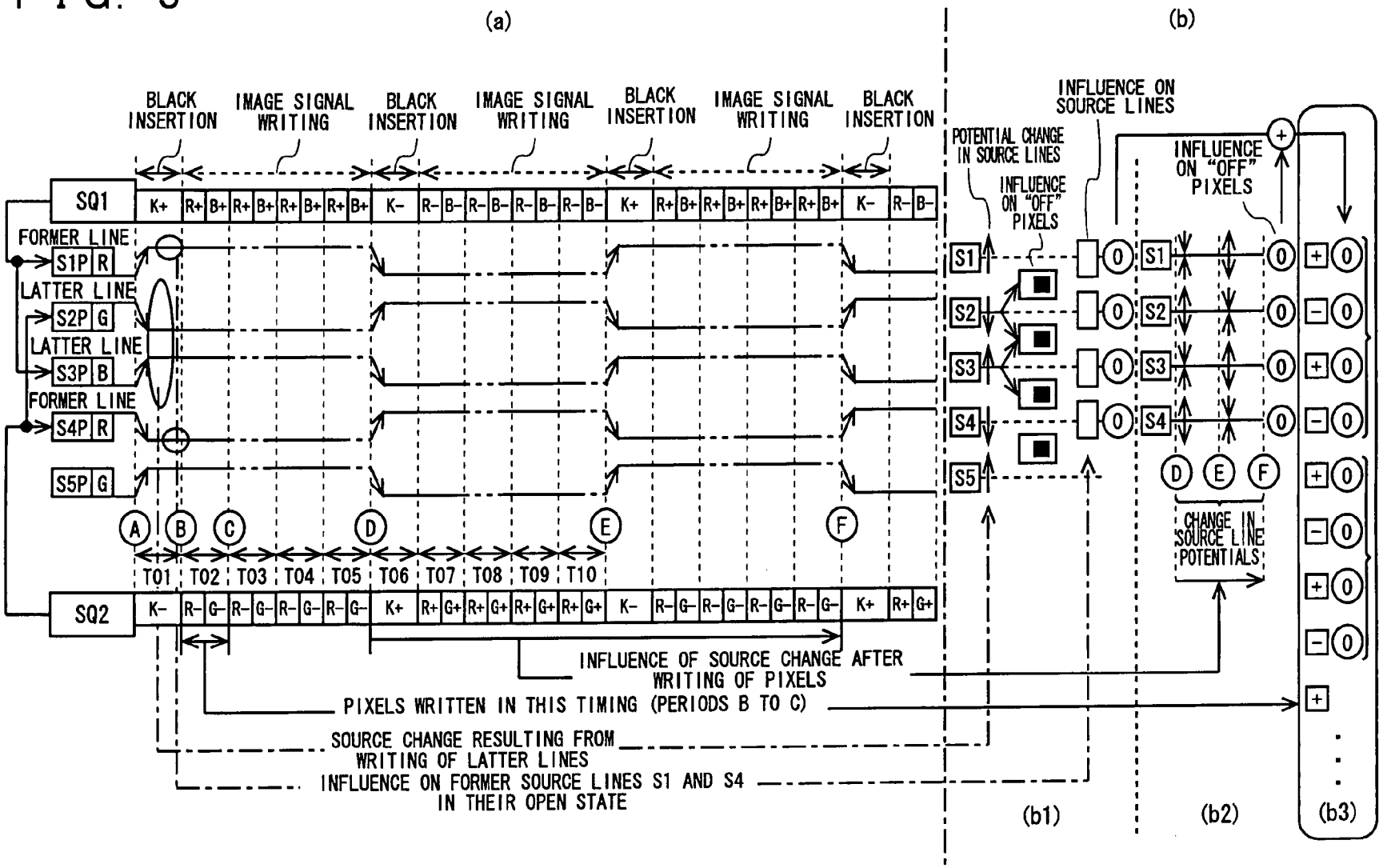
FIG. 5 is a timing diagram illustrating events occurring as a result of control performed by the liquid crystal display device according to the second embodiment of the present invention.

By performing a control operation similar to that of the first embodiment using these CTL0 and CTL1, shown in (c) of FIG. 3, results similar to those obtained in the first embodiment can be obtained for SP1 to SP4, which is shown in (b) of FIG. 3. The present embodiment is different from the first embodiment in the "K" portion and the "G4", "G8", "B4", and "B8" portions of S2P and S3P. In the present embodiment, unlike in the first embodiment, a non-display signal voltage is supplied to S2P and S3P in the former part of T01. Therefore, as shown in (a) of FIG. 5, potential changes in opposite polarities simultaneously occur in any adjacent source lines in T01. Hence, the influences on OFF pixels are counteracted by each other, as shown in (b1) of FIG. 5, and thus such influences do not occur substantially. In addition, since none of the source lines is in an open state in the period T01, no influence is exerted on the source lines. The source line changes at the time of the subsequent writing of a non-display signal are also counteracted, as shown in (b2) of FIG. 5. Accordingly, on the whole, it can be said that, as shown in (b3) of FIG. 5, luminance differences caused by the influence of the writing of a non-display signal voltage do not occur in the pixels on any source line.

Note that in the example of (b) of FIG. 3, there exist portions in S2P and S3P where a display signal voltage is present only for the time of T/2 (T is a time equivalent to T01, T02, etc.), such as G4 and B4 in the latter part of T05. However, in practice, the write time of a display signal voltage, i.e., the time that the multiplexer part 1706 is electrically conducted and a display signal voltage is supplied from the source driver 103, is also T/2 in other portions, and thus the rest of the time of T/2 does not have any significant meaning. Thus, this does not present any problems.

In other words, even if R, G, or B is present over the period T, the latter part of that period is merely a residual potential on the source line, and thus it does not contribute much to the writing to the pixels.

As a variant of the present embodiment, CTL0 and CTL1 may be such as those shown in (d) of FIG. 3. In this example, in the periods of T01 and T06, only the former part of each period is "HIGH" and the latter part is "LOW", but S1P to S4P are the same as those shown in (c) of FIG. 3.

Figure 23:
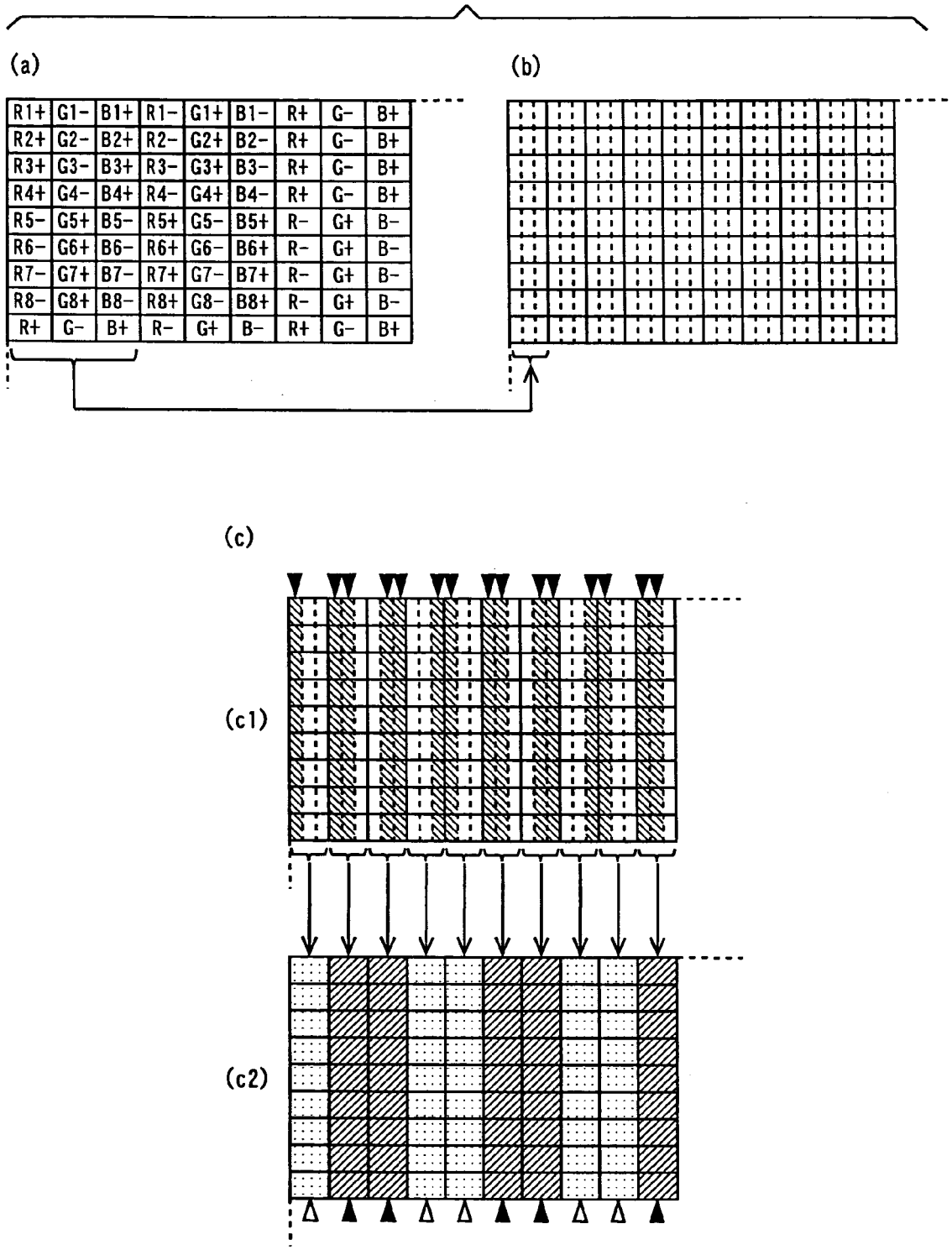
FIG. 23 is a diagram illustrating the consistency of a display screen in a display region.

Accordingly, a consistent image without display non-uniformity, such as that shown in (b) of FIG. 23, can be obtained.

As described above, according to a liquid crystal display device of the second embodiment, in addition to the effect of the first embodiment, the effect of removing vertical lines, such as that shown in (c2) of FIG. 23, can be further obtained.

(Third Embodiment)

Figure 6:
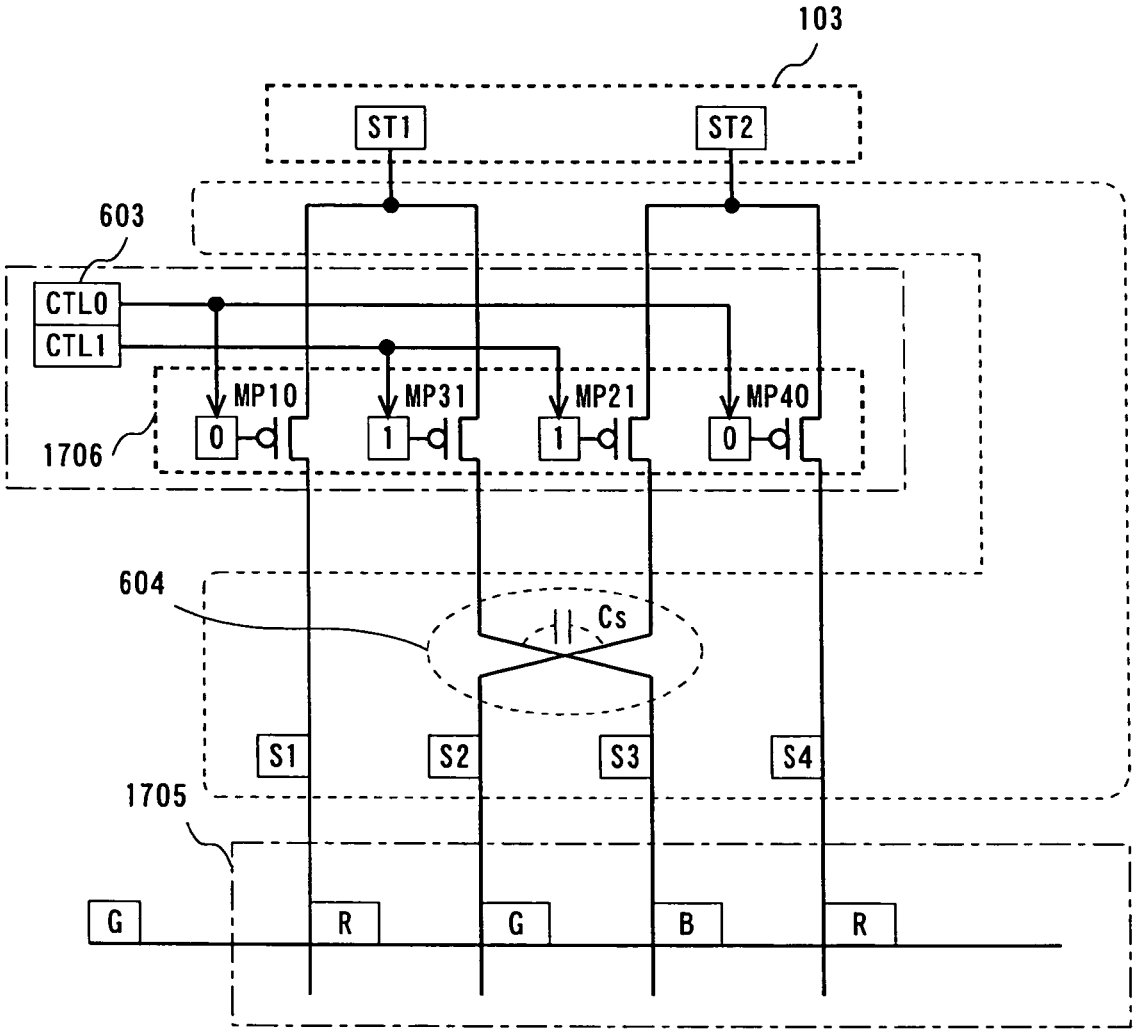
FIG. 6 is a diagram showing a part of the configuration of the liquid crystal display device according to the third embodiment of the present invention.

In general, the configuration of a liquid crystal display device according to the third embodiment of the present invention is substantially the same as that of the second embodiment, shown in FIG. 1, but as shown in FIG. 6, the configuration of a group of source lines 601 is partly different from that of the second embodiment (accordingly, multiplexer control signals 603 are also different). In the foregoing second embodiment, as shown in FIG. 2, the intersection part 204 of the source lines S2 and S3 is present between the source driver 103 and the multiplexer part 1706, but in the third embodiment, as shown in FIG. 6, an intersection part 604 is configured between a multiplexer part 1706 and a display region part 1705. The control of a driving method of the present embodiment is the same as that of the second embodiment, as shown in (b) of FIG. 3, but in terms of the transitional operation, the following points are different, and accordingly the display quality may be different.

In the source line intersection part 604, as shown in FIGS. 2 and 6, an interlayer capacitance Cs is present which is proportional to the counter area and the dielectric constant of an internal insulation material and which is inversely proportional to the counter distance. The interlayer capacitance Cs becomes a non-negligible value because of the structure of the liquid crystal panel, and may cause an interference problem between intersecting source lines. In the case of FIG. 2, regardless of whether MP21 and MP31 in the multiplexer part 1706 are OFF or ON, the signal voltages of ST1 and ST2 are applied to the interlayer capacitance Cs. In addition, when MP21 and MP31 in the multiplexer part 1706 are OFF as viewed from the source lines, the interlayer capacitance Cs between the source lines S2 and S3 is absent. On the other hand, in the case of the present embodiment, shown in FIG. 6, when MP31 and MP21 in the multiplexer part 1706 are OFF, no voltage is supplied from ST1 and ST2, and the interlayer capacitance Cs between the source lines S2 and S3 is present.

Now, the above-described states are described for the period T02, for example, of the timing diagram of FIG. 3. In the case of the foregoing second embodiment, in the former part of the period T02, R1+ of SQ1 and R1− of SQ2 are applied to the interlayer capacitance Cs, and in the latter part of the period T02, the R1+ and R1− are replaced by other colors B1+ and G1−, respectively. For example, in the case where the entire screen is red, the changes from R1+ to B1+ and from R1− to G1− are great, and thus the degree of the influence of the interlayer capacitance Cs is great. In the former part of the period T02, K− remains in the source line S2 and K+ remains in the source line S3, but in the latter part of the period T02, the G1− which has been influenced by the potential difference of the above interlayer capacitance Cs is applied to the source line S2, and the B1+ which has been similarly influenced by the potential difference of the above interlayer capacitance Cs is applied to the source line S3. Needless to say, the degree of such an influence depends on the output capability of the source driver 103. In addition, the periods T03 to T05 are similarly influenced by other colors.

In the case of the third embodiment, in the former part of the period T02, K− and K+ each remain in the interlayer capacitance Cs between the source lines S2 and S3, and in the latter part of the period T02, the K− and K+ are replaced by G1− and B1+, respectively, and the G1− and B1+ are applied to the source lines S2 and S3 and the interlayer capacitance Cs. The degree of the influence of the interlayer capacitance Cs in this case as to, for example, cyan (green and blue light is generated) is much the same as in the second embodiment.

However, for the period T03, G1− and B1+ change to G2− and B2+, respectively, and thus the third embodiment is less susceptible to the influence of the interlayer capacitance Cs. The same is also true of the periods T04 and T05.

As for the entire frame, in the second embodiment the pixels on a source line Sj, which corresponds to j=4i−3 or j=4i−2, where i=1,2,3 . . . , maybe influenced by the luminance levels corresponding to the display signal voltages on the right and left sides (i.e., other colors) of the respective pixels, but in the third embodiment there is an advantage in that the pixel is influenced only by a non-display signal voltage or a pixel of the same color present in the previous row of the pixel.

As described above, according to a liquid crystal display device of the third embodiment, in addition to the effect of the second embodiment, the effect of avoiding an image degradation can be further obtained.

(Fourth Embodiment)

Figure 7:
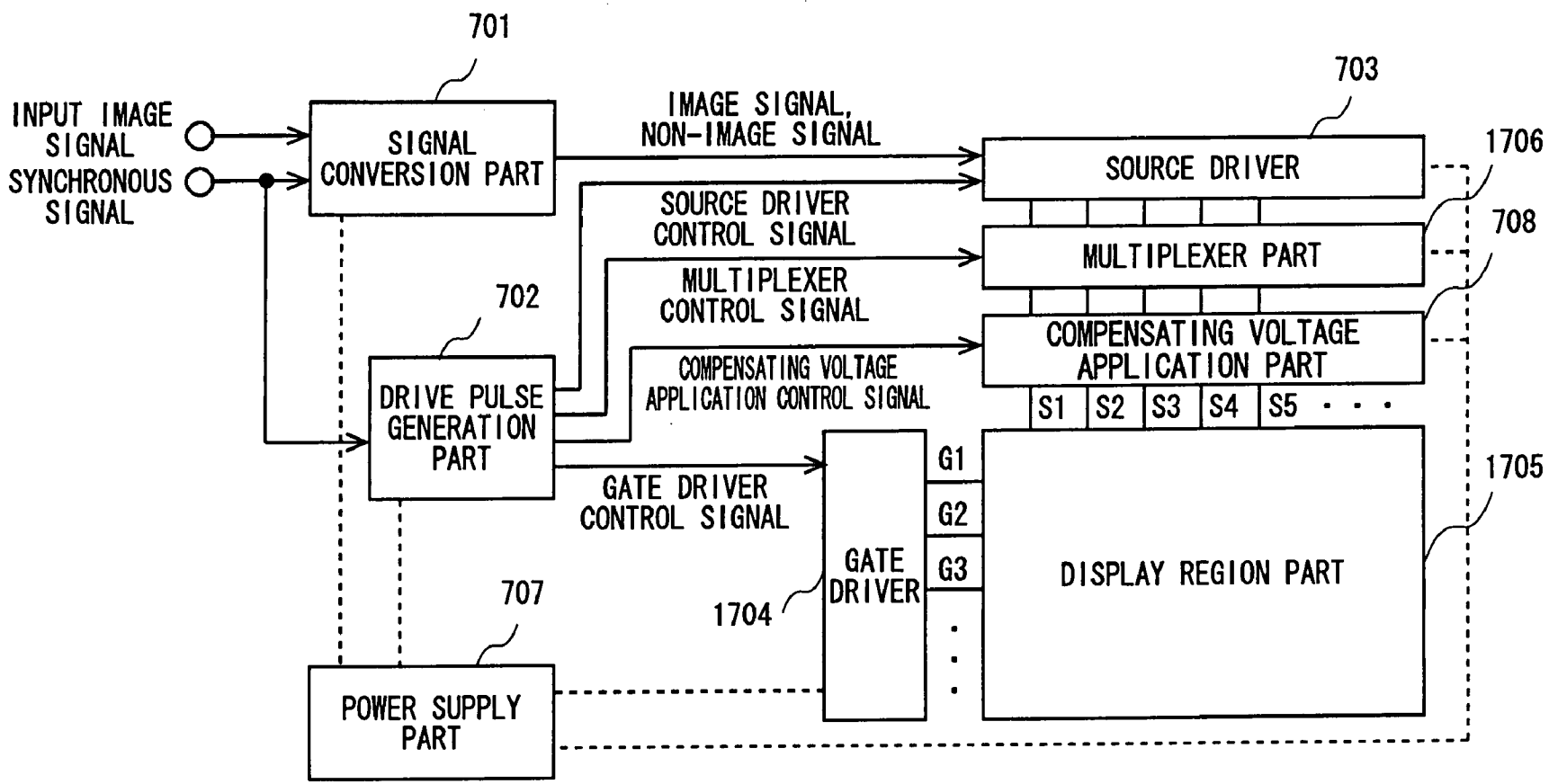
FIG. 7 is a diagram showing the configuration of a liquid crystal display device according to fourth, fifth, sixth, and eighth embodiments of the present invention.
Figure 8:
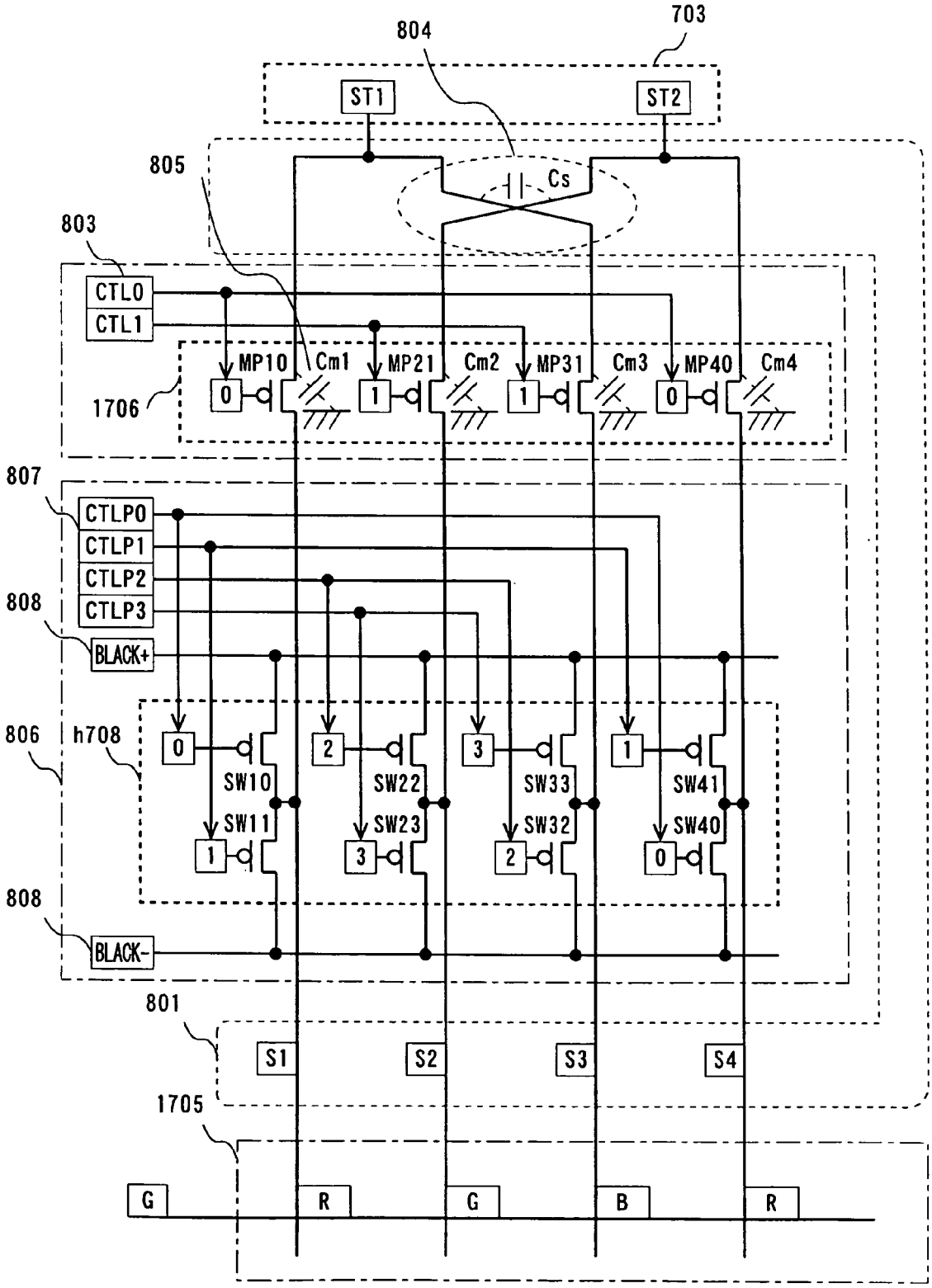
FIG. 8 is a diagram showing a part of the configuration of the liquid crystal display device according to the fourth and eighth embodiments of the present invention.
Figure 9:
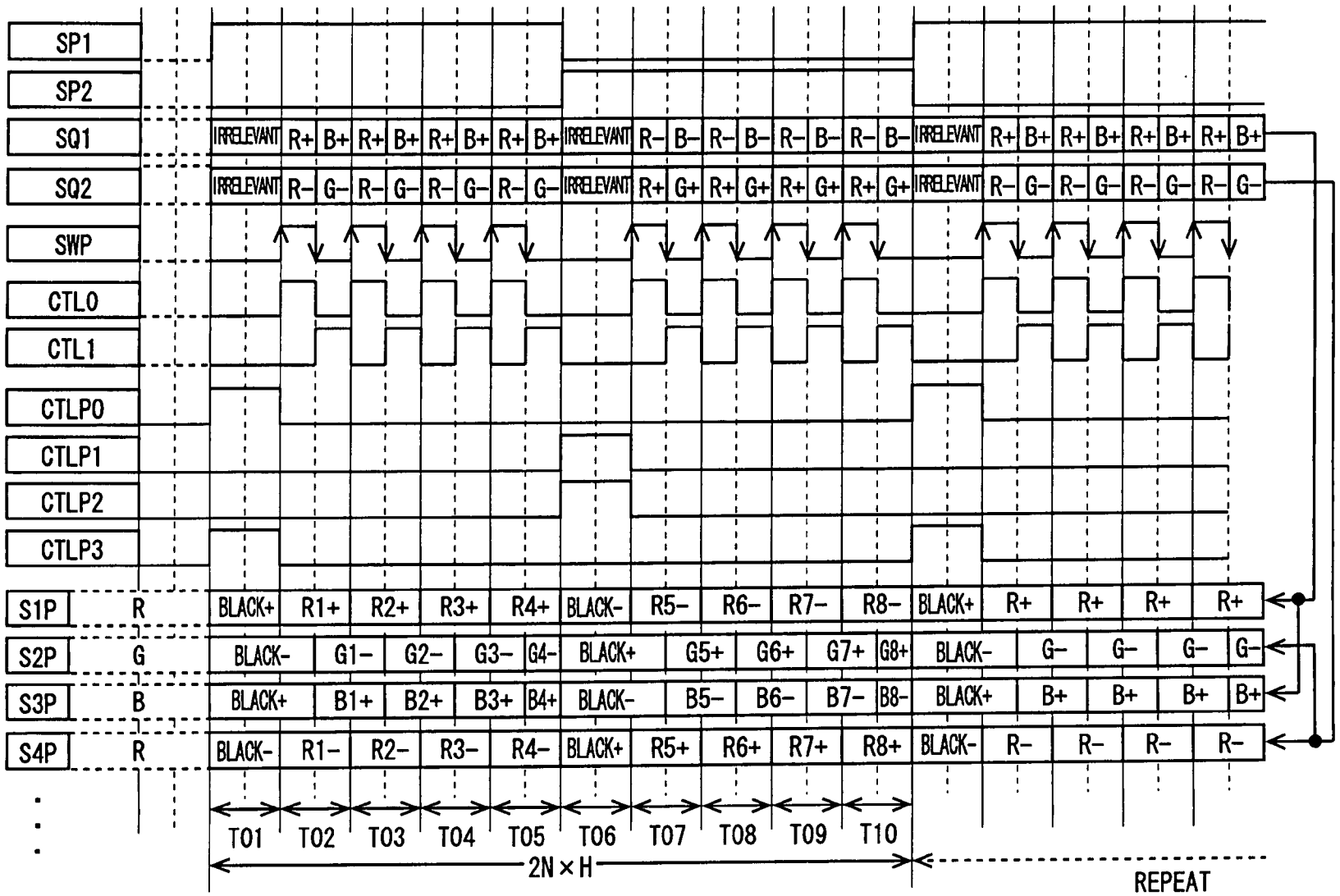
FIG. 9 is a timing diagram illustrating control performed by the liquid crystal display device according to the fourth embodiment of the present invention.

FIG. 7 is a diagram showing the configuration of a liquid crystal display device according to the fourth embodiment of the present invention, FIG. 8 is a diagram showing a part of such a configuration, and FIG. 9 is a timing diagram. With reference to FIGS. 7, 8, and 9, the driving thereof is described below.

The configuration of a liquid crystal display device according to the fourth embodiment, shown in FIG. 7, is such that in a conventional liquid crystal display device, shown in FIG. 17, the signal conversion part 1701, the drive pulse generation part 1702, the source driver 1703, and the power supply part 1707 are respectively replaced with a signal conversion part 701, a drive pulse generation part 702, a source driver 703, and a power supply part 707. Further, a compensating voltage application part 708 is additionally provided between a multiplexer part 1706 and a display region part 1705, and a compensating voltage, different from the aforementioned display signal voltage or non-display signal voltage, is supplied from the power supply part 707. Except for these, all other elements are equal to those of the conventional liquid crystal display device, shown in FIG. 17, and thus like reference numerals are used to indicate like elements and the descriptions thereof are omitted.

FIG. 8 shows some of the elements shown in FIG. 7, i.e., the source driver 703, the display region part 1705, the multiplexer part 1706, and the compensating voltage application part 708. Note that a group of source lines is indicated as "801" and multiplexer control signals are indicated as "803".

The constituent section including the compensating voltage application part 708, compensating voltage application control signals 807 for controlling the compensating voltage application part 708, and power lines 808 for supplying compensating voltages of + and − polarities is referred to as compensating voltage application control means 806. The "black+" and "black−" shown in the figure are symbols which respectively indicate the positive and negative voltages of compensating voltages.

In the compensating voltage application part 708, two switching elements are provided for each source line, and these two switching elements are connected between the source line and the + and − power lines 808. To the control terminal of the switching element is supplied the compensating voltage application control signal 807, as shown in the figure. In the figure, the switching element is indicated by a two-digit number following "SW", and the first digit indicates the compensating voltage application control signal number and the second digit indicates the source line number. The compensating voltage application control signal 807 has four types, including CTLP0 to CTLP3.

The control and operation of the present embodiment are described below with reference to FIG. 9.

In FIG. 9, the symbols are the same as those of the foregoing first to third embodiments, except for CTLP. The present embodiment is different from the second embodiment in that in SQ1 and SQ2 the "K+" and "K−", which indicate non-display signal voltages in the periods of T01 and T06, are changed to "irrelevant" (i.e., can be arbitrary), and in that there are added compensating voltage application control signals of CTLP0 to CTLP3. In addition, CTL0 and CTL1 are LOW in these "irrelevant" periods (in the actual operation, the source driver 703 is disconnected from each source line in the "irrelevant" period), which is also different from the second embodiment. Furthermore, the present embodiment is different from the second embodiment in that there are shown the results of the application of black+ or black− from the power line 808 in the compensating voltage application part 708 in the "irrelevant" period, which is performed by the operation of each switching element in the compensating voltage application part 708 in the HIGH period for CTLP0 to CTLP3 in S1P to S4P in the figure. It will be clear, as is the case with the source driver 703, that the presence of a rise or fall in the SWP in the "irrelevant" period is of no relevance. Other periods are basically the same as those of the second embodiment.

Next, the operation of an application of black+ and black− to source lines is described. In the period T01, CTLP0 and CTLP3 are HIGH, and thus SW10, SW40, SW23, and SW33 take an ON state. On the other hand, CTLP1 and CTLP2 are LOW, and thus SW11, SW41, SW22, and SW32 take an OFF state. Consequently, black+ is applied and charged to the source lines S1 and S3, and black− is applied and charged to the source lines S2 and S4. In the period T06, the relationship of HIGH and LOW for CTLP0 to CTLP3 is reversed from that in the period T01. Accordingly, the ON and OFF states of each switching element are also reversed, and consequently, the polarity of a compensating voltage to be applied to each source line is also reversed.

By the configuration and driving method, such as those described above, timing driving similar to that of the second embodiment is accomplished, whereby a high-quality display without vertical lines can be obtained.

Although the values of the compensating voltage are indicated by black+ and black−, and the above description is directed to the voltage that corresponds to a non-display signal voltage in the foregoing first to third embodiments, i.e., the compensating voltage for preventing the aforementioned reverse transition in the OCB liquid crystal cell, it will be appreciated that the driving technique of the present embodiment can also be introduced to other objects.

The voltage value of the compensating voltage has an advantage in that it can be set independently of and relatively free from the constrains from the signal system, such as the signal conversion part 701. For example, for the non-display signal voltage, its maximum level is limited based on the dynamic range width of the output stage of the source driver, but the compensating voltage of the present embodiment can be set to any level in a wide range up to the withstand voltage of the output stage of the source driver. In addition, by allowing the compensating voltage to be variable, environmental characteristics and individual differences of the liquid crystal panels can be easily supported.

As described above, according to a liquid crystal display device of the fourth embodiment, it is possible to appropriately supply a compensating voltage to a liquid crystal panel without degradation in display quality.

(Fifth Embodiment)

Figure 10:
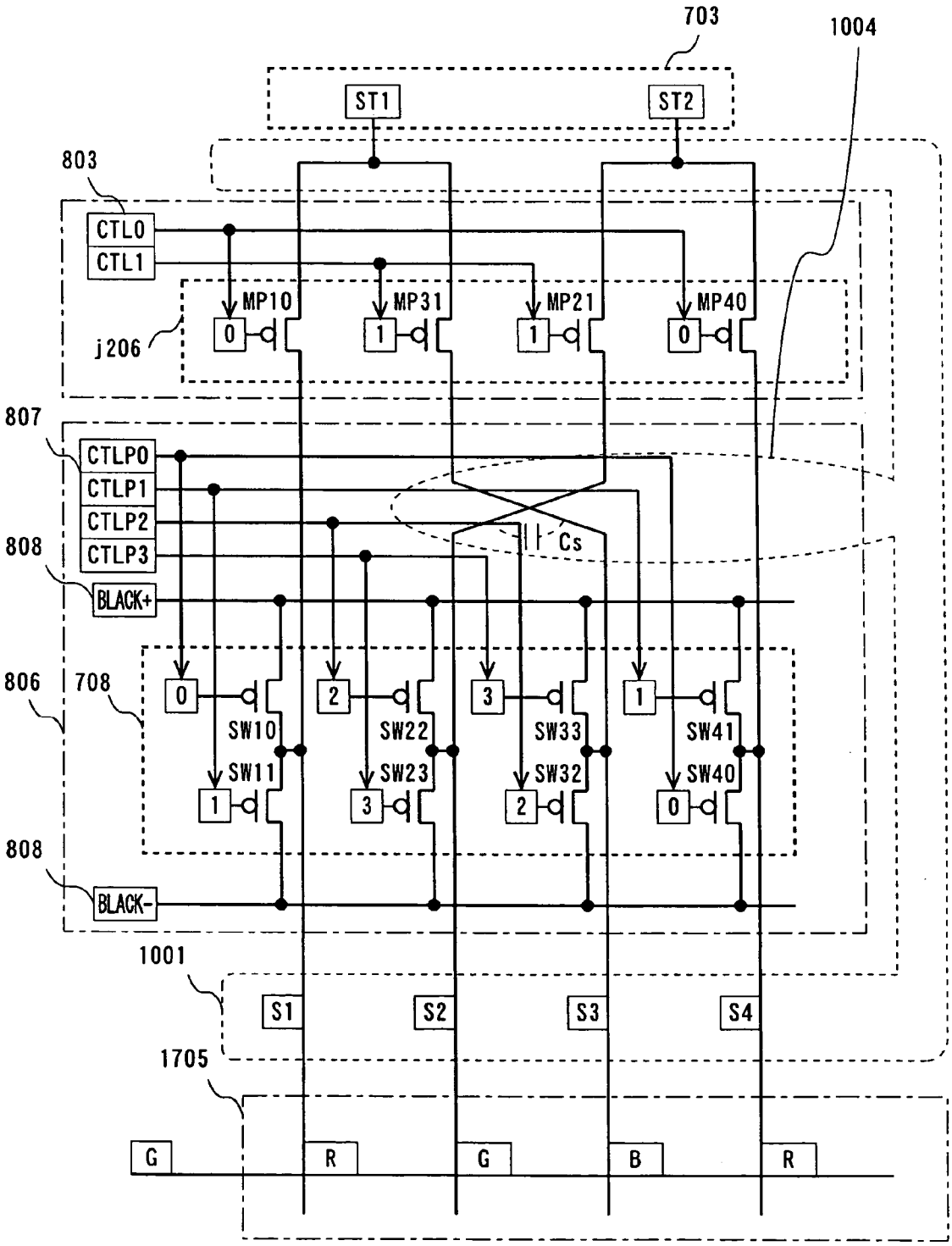
FIG. 10 is a diagram showing a part of the configuration of the liquid crystal display device according to the fifth embodiment of the present invention.

In general, the configuration of a liquid crystal display device according to the fifth embodiment of the present invention is substantially the same as that of the fourth embodiment, shown in FIG. 7, but as shown in FIG. 10, the configuration of a group of source lines 1001 is partly different. Specifically, in the foregoing fourth embodiment, as shown in FIG. 8, the intersection part 804 of the source lines S2 an S3 is present between the source driver 703 and the multiplexer part 1706, but in the present embodiment, an intersection part 1004 of source lines S2 and S3 is configured between a multiplexer part 1706 and a compensating voltage application part 708. The control of a driving method according to the present embodiment is the same as that of the fourth embodiment, shown in FIG. 9, but in terms of the transitional operation, there are differences similar to those between the foregoing second and third embodiments, and thus the display quality may also be different.

The fifth embodiment is different from the foregoing embodiments in that the non-display signal voltages of K+ and K− are replaced by the compensating voltages of black+ and black−, respectively. Accordingly, in the foregoing fourth embodiment, as for the entire frame, the pixels on a source line Sj, which corresponds to j=4i−3 or j=4i−2, where i=1,2,3 . . . , may be influenced by the luminance levels corresponding to the display signal voltages on the right and left sides (i.e., other colors) of the respective pixels, but in the fifth embodiment there is an advantage in that the pixel is influenced only by a compensating voltage or a pixel of the same color present in the previous row of the pixel. Therefore, according to a liquid crystal display device of the fifth embodiment, in addition to the fourth embodiment, the effect of preventing an image degradation can be obtained.

(Sixth Embodiment)

Figure 11:
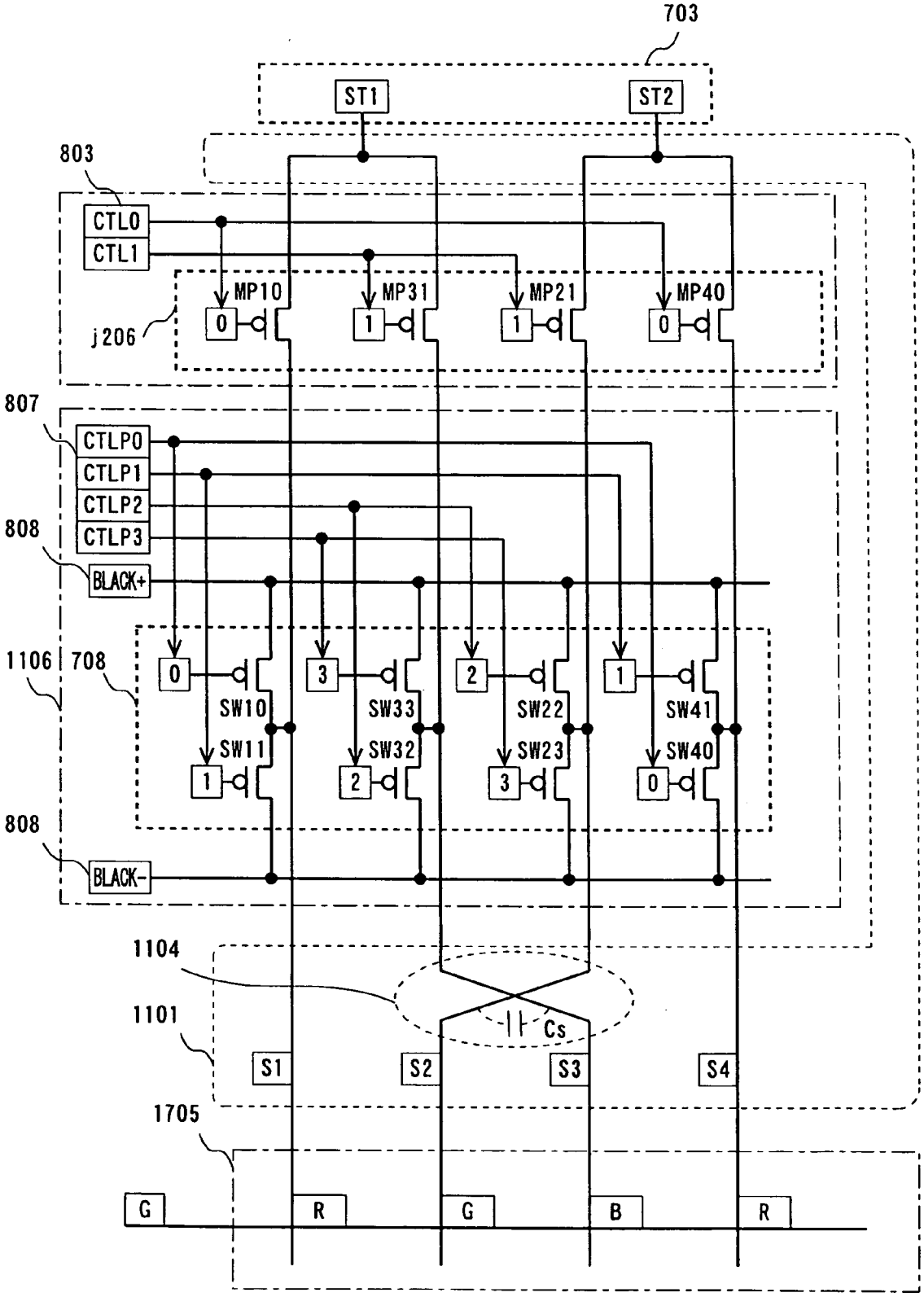
FIG. 11 is a diagram showing a part of the configuration of the liquid crystal display device according to the sixth embodiment of the present invention.

The configuration of a liquid crystal display device according to the sixth embodiment of the present invention is substantially the same, on the whole, as that of the fourth embodiment, shown in FIG. 7, but as shown in FIG. 11, the configuration of a group of source lines 1101 is partly different. Specifically, in the foregoing fourth embodiment, as shown in FIG. 8, the intersection part 804 of the source lines S2 an S3 is present between the source driver 703 and the multiplexer part 1706, but in the present embodiment, an intersection part 1104 of source lines S2 and S3 is constructed between a compensating voltage application part 708 and a display region part 1705. Accordingly, in comparison with the example of FIG. 8, the switching elements SW in the compensating voltage application part 708, which are related to the source lines S2 and S3, are switched, the connections between these switching elements and CTLP2 and CTLP3 are changed, and each switching element is numbered in accordance with the aforementioned principle. The portion that includes the compensating voltage application part 708, compensating voltage application control signals 807, and power lines 808 is referred to as the compensating voltage application control means 1106.

The control of a driving method according to the present embodiment is the same as that of the fourth embodiment, shown in FIG. 9, and the transitional operation is also the same as that of the fifth embodiment, and thus the descriptions thereof are omitted here. In the sixth embodiment too, there is an advantage, as in the foregoing fifth embodiment, in that the pixel is influenced only by a compensating voltage or a pixel of the same color present in the previous row of the pixel. Thus, the effect of preventing an image degradation can be obtained.

(Seventh Embodiment)

Figure 18:
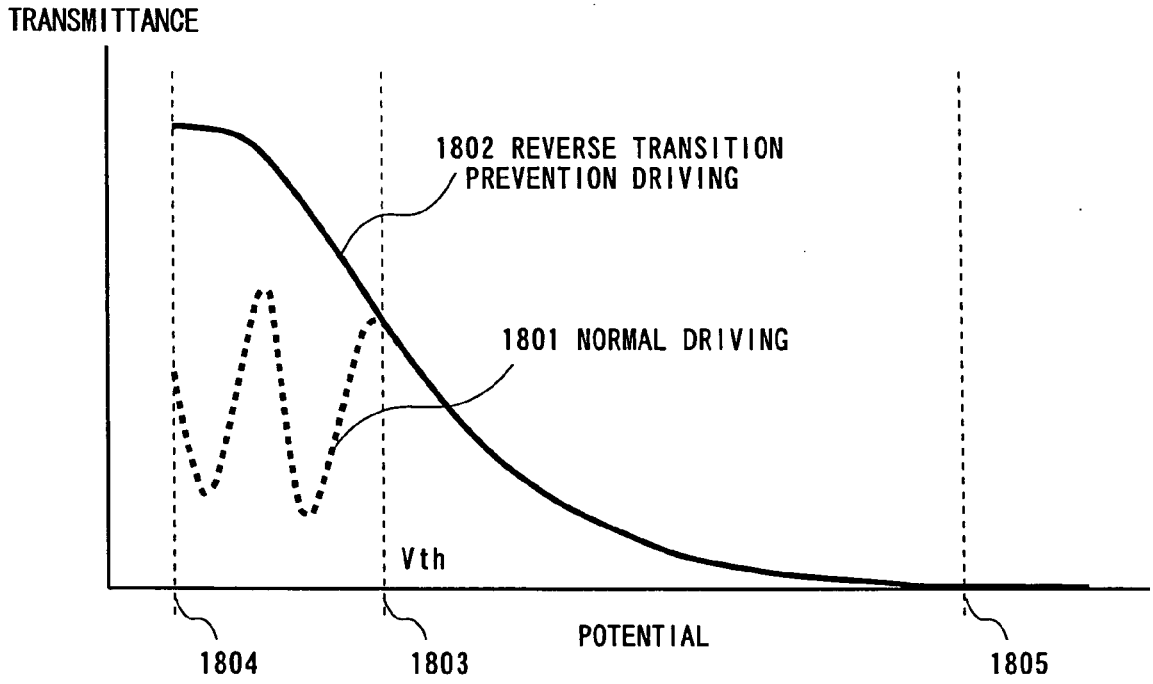
FIG. 18 is a diagram illustrating potential-transmittance curves for OCB.

An OCB panel having characteristics shown by the potential-transmittance curves in FIG. 18 is a so-called normally white liquid crystal panel in which a white display is provided when no voltage is applied. Therefore, to enhance a display performance, specifically, a contrast performance, performing a black display with the lowest possible transmittance is important. The application voltage for providing this lowest transmittance may vary between the pixels of R, G, and B due to the characteristics of the OCB panel.

In order to solve the above problem, a liquid crystal display device according to the seventh embodiment of the present invention is configured such that an optimum compensating voltage for each of R, G, and B is applied to the pixels.

Figure 12:
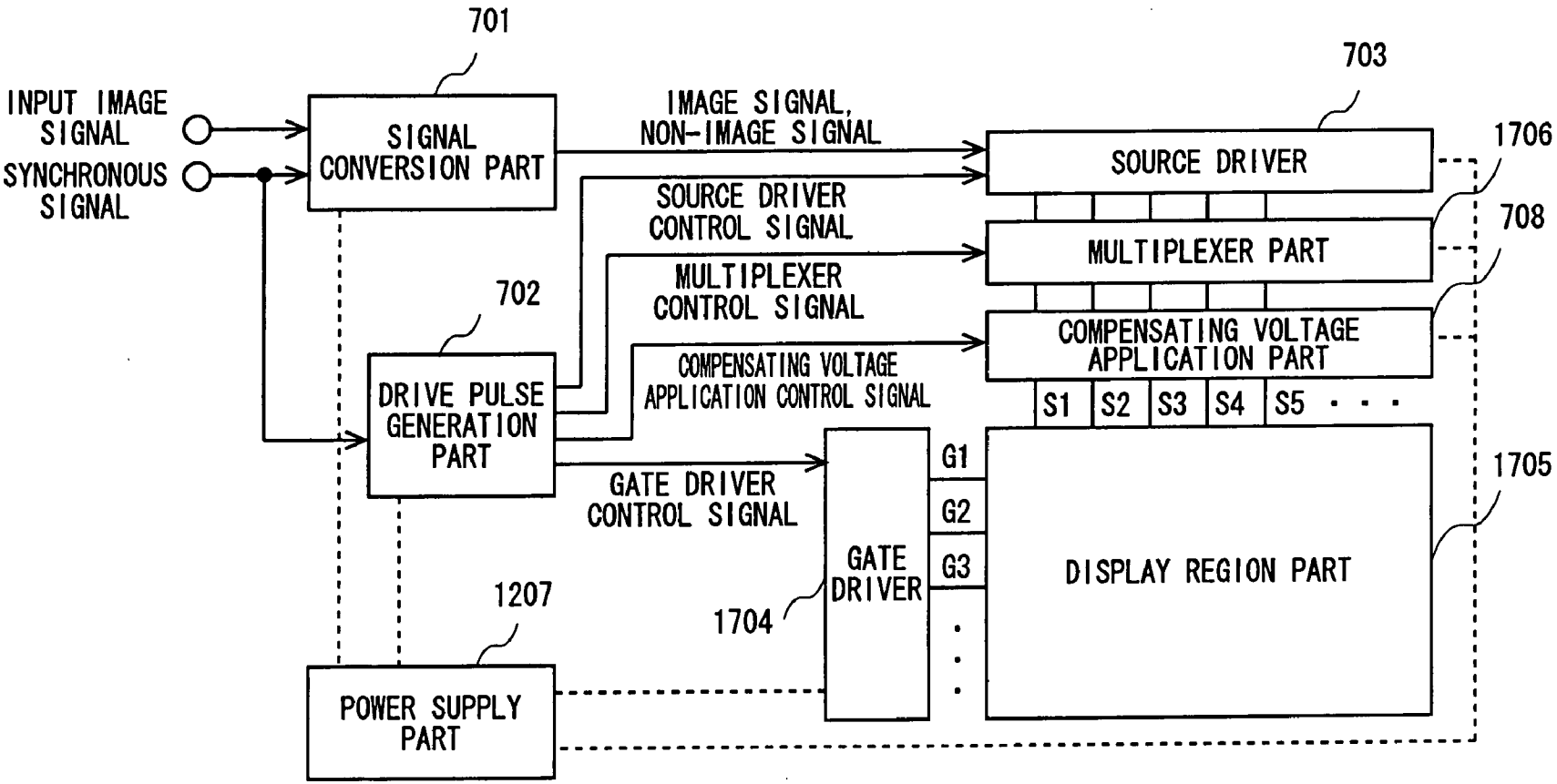
FIG. 12 is a diagram showing the configuration of a liquid crystal display device according to a seventh embodiment of the present invention.
Figure 13:
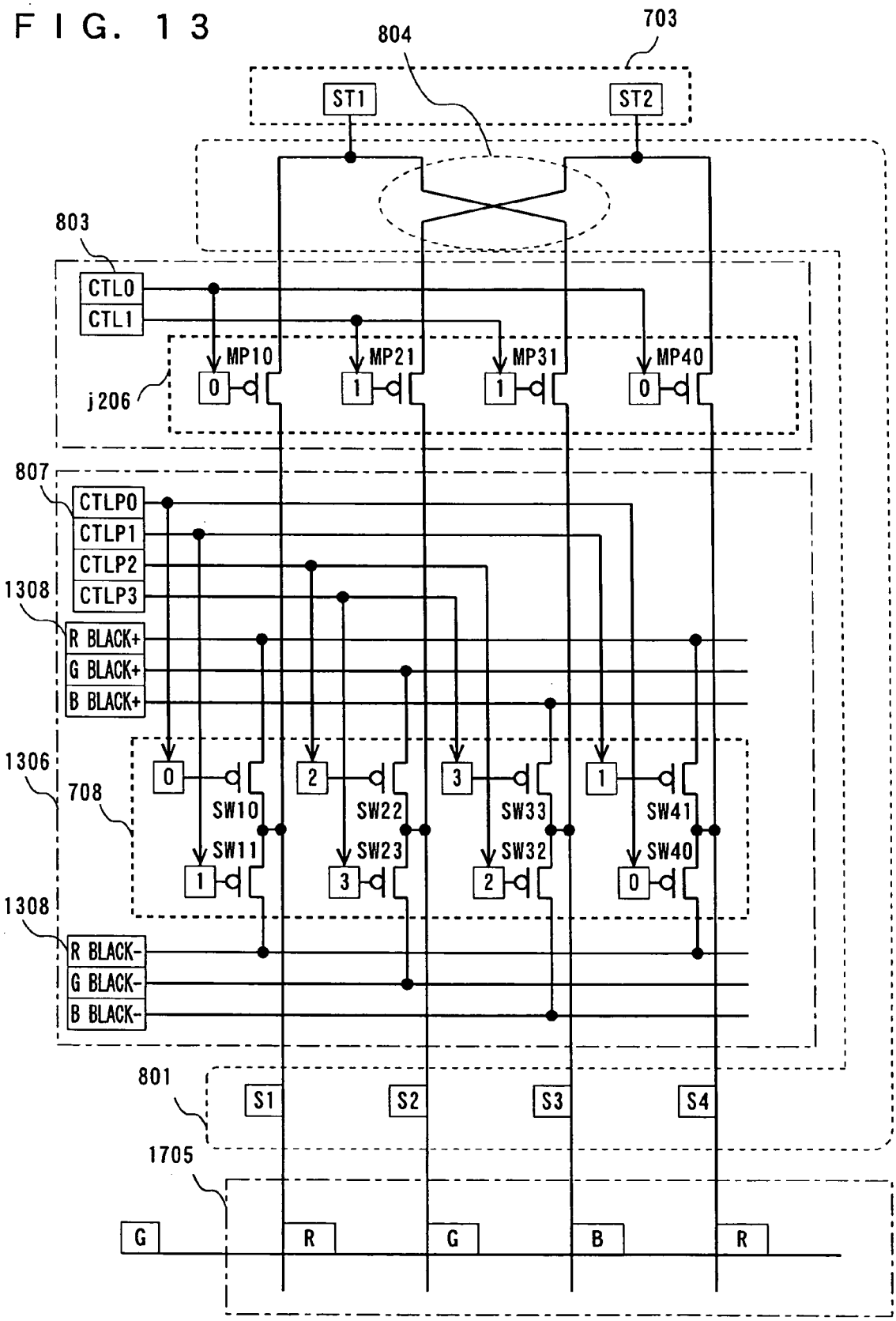
FIG. 13 is a diagram showing a part of the configuration of the liquid crystal display device according to the seventh embodiment of the present invention.
Figure 14:
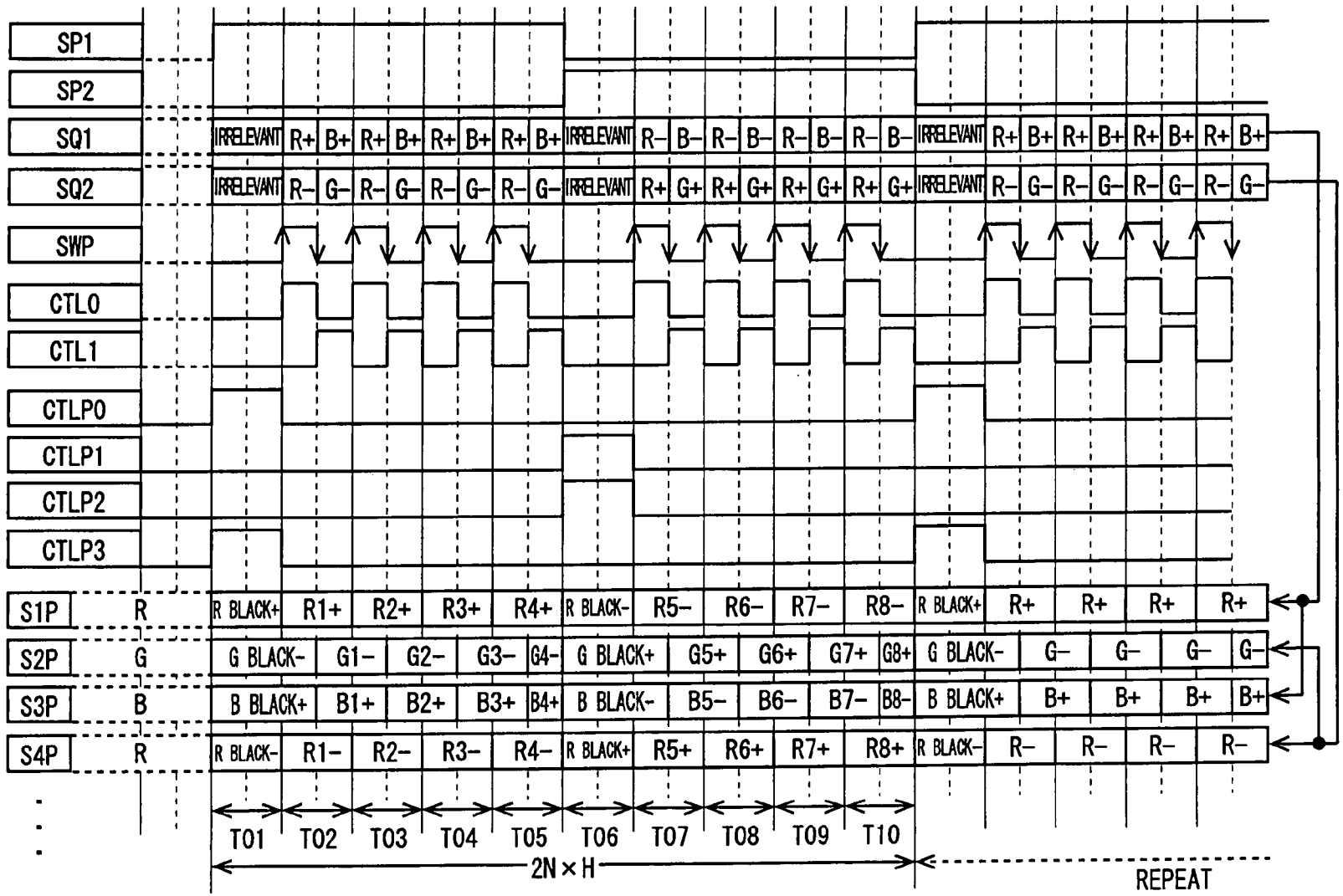
FIG. 14 is a timing diagram illustrating control performed by the liquid crystal display device according to the seventh embodiment of the present invention.

FIG. 12 is a diagram showing the configuration of a liquid crystal display device according to the seventh embodiment of the present invention, FIG. 13 is a diagram showing a part of the configuration, and FIG. 14 is a diagram illustrating timing.

With reference to FIGS. 12, 13, and 14, the driving thereof is described below.

The configuration of a liquid crystal display device according to the seventh embodiment, shown in FIG. 12, is such that in a liquid crystal display device according to the fourth embodiment, shown in FIG. 7, the power supply part 707 is replaced with a power supply part 1207.

FIG. 13 shows some of the elements shown in FIG. 12, i.e., a source driver 703, a display region part 1705, a multiplexer part 1706, and a compensating voltage application part 708. The constituent section including the compensating voltage application part 708, compensating voltage application control signals 807 for controlling the compensating voltage application part 708, and power lines 1308 for supplying compensating voltages of R, G, and B with + and – polarities is referred to as compensating voltage application control means 1306. In FIG. 13, "R black+" and "R black–" are symbols which respectively indicate the positive and negative voltages of compensating voltages related to "R". The same applies to "G" and "B". That is, the present embodiment is the same as the fourth embodiment illustrated in FIG. 8 except for the compensating voltage application control means 1306, and CTL and CTLP are also the same. A switching element of the compensating voltage application control means 1306 is connected to a power line having the same attribute as the R, G, or B attribute of a source line to which the switching element is connected.

The control and operation of the present embodiment is described below with reference to FIG. 14.

The timing diagram, shown in FIG. 14, is different from that of the foregoing fourth embodiment, shown in FIG. 9, in that in S1P to S4P, in the periods of T01 and T06, the letters "R", "G", and "B", which indicate the aforementioned compensating voltages related to R, G, and B, are added before the symbols "black+" and "black–" which indicate compensating voltages.

To the source lines are applied "R black+", "R black–", "G black+", "G black–", "B black+", and "B black–", as shown in S1P to S4P, by a similar control operation to that of the fourth embodiment.

By the configuration and driving method, such as those described above, it becomes possible to apply an optimum compensating voltage of each R, G, and B to the pixels. Thus, a higher display quality than that of the fourth embodiment can be obtained.

(Eighth Embodiment)

The configuration of a liquid crystal display device according to the eighth embodiment of the present invention is substantially the same as that of the fourth embodiment, shown in FIG. 7, but the present embodiment is characterized in that the charging capability of a source driver 703 is supplemented by using, for example, electrode capacitances 805 (Cm1 to Cm4) of TFT switching elements in an OFF state in a multiplexer part 1706 in FIG. 8. The driving method thereof is described with reference to FIG. 15.

Figure 15:
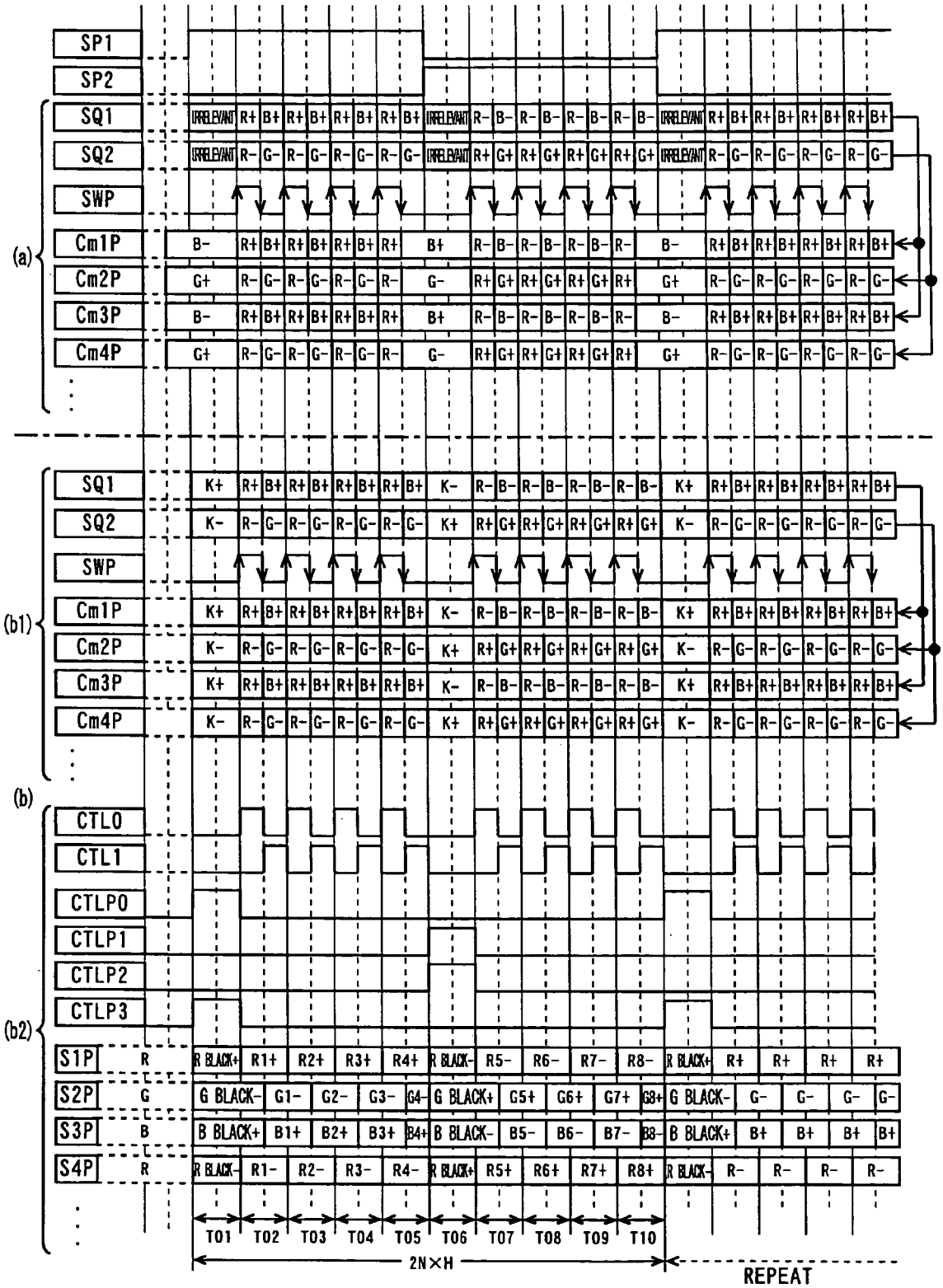
FIG. 15 is a timing diagram illustrating control performed by the liquid crystal display device according to the eighth embodiment of the present invention.
Figure 16:
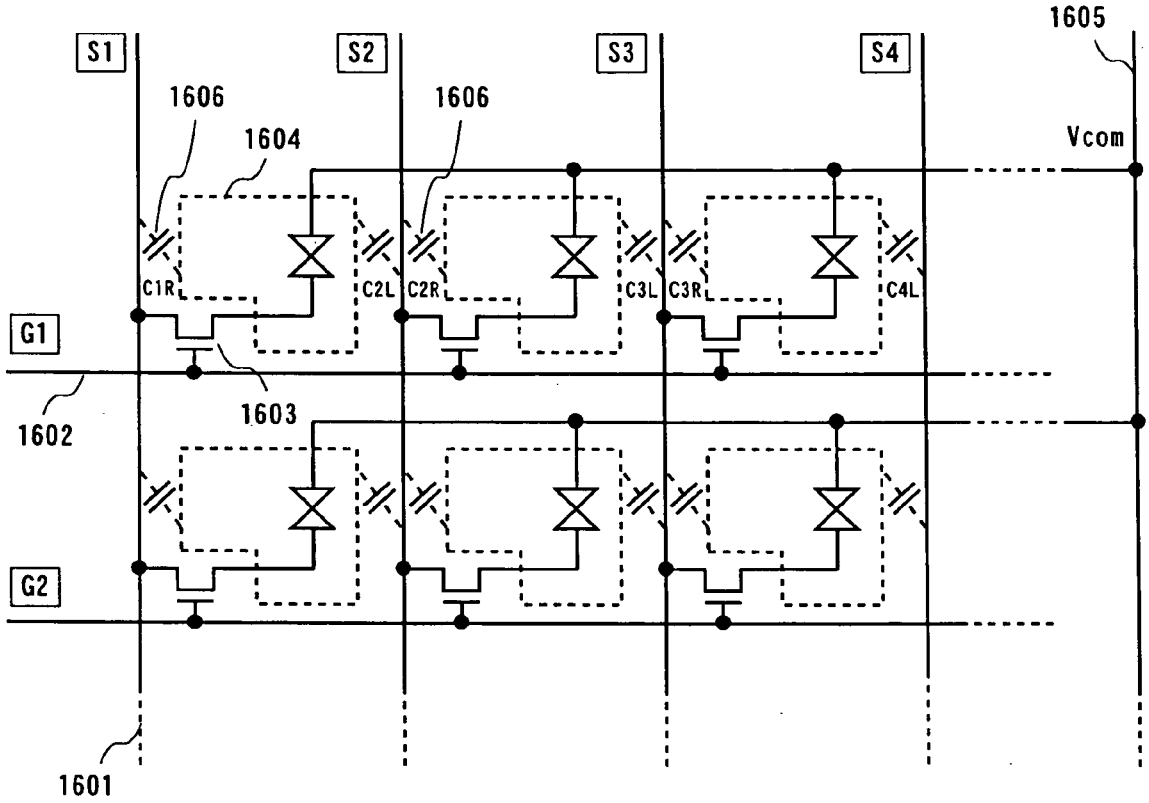
FIG. 16 is a diagram showing the configuration of a display region of a liquid crystal display device.

Prior to describing the driving method, the problem of the foregoing fourth embodiment is described with reference to (a) of FIG. 15. Cm1P to Cm4P in (a) of FIG. 15 show the potential states of the electrode capacitances Cm1 to Cm4 in the fourth embodiment, shown in FIG. 8. Here, source driver control signals, such as SP1, SP2, and SWP, and SQ1 and SQ2, which are the output voltages of ST1 and ST2, are the same as those shown in the timing diagram of the fourth embodiment, shown in FIG. 9. In a cycle of 2NH, the output voltages of SQ1 and SQ2 is charged to the electrode capacitances Cm1 to Cm4 in the periods other than the periods T01 and T06, but in the periods T01 and T06, because there is no rise or fall of SWP, the output from the source driver 703 is not applied and thus the display signal voltages charged in the previous period remain. Because of this state, the source driver 703 supplies a display signal voltage with a polarity opposite to that of the aforementioned remained voltage to the source lines S1 and S4 and all Cms in the rise timing of SWP of T02 or T07, and thus the source driver 703 requires a high output capability, which was a problem in the fourth embodiment.

In the present embodiment, the operation is performed in the timing shown in (b1) and (b2) of FIG. 15, by using CTL and CTLP of the fourth embodiment, shown in FIG. 9, and SQ1, SQ2, and SWP of the first embodiment, shown in FIG. 3. The periods other than T01 and T06 in (b1) of FIG. 15 are similar to those of the fourth embodiment, shown in (a) of FIG. 15. In the periods of T01 and T06, both CTL0 and CTL1 are LOW, and thus all switching elements in the multiplexer part 1706 become OFF. Accordingly, in the periods of T01 and T06, a non-display signal voltage with the same polarity as that of the display signal voltages to be supplied in accordance with SWP from the source driver 703 in the subsequent periods T02 and T07 is applied and charged to all Cms in the multiplexer part 1706. Therefore, it becomes easy for the source driver 703 to charge display signal voltages to all Cms in the periods T02 and T07. Note that, as shown in (b2) of FIG. 15, the potentials of the source lines are the same as those of the fourth embodiment, shown in FIG. 9, but strictly speaking, an improvement is made on a charge relevant to an auxiliary charge to the above-described Cm.

As described above, according to a liquid crystal display device of the eighth embodiment, the effect of improving a display signal voltage writing capability to the source lines, i.e., the pixels, can be obtained.

INDUSTRIAL APPLICABILITY

As has been described above, according to liquid crystal display devices of the present invention, reduction in the write time of a display signal voltage can be avoided, and therefore the writing of a display signal voltage, a non-display signal voltage, and a compensating voltage becomes easy, making it possible to prevent an image degradation resulting from insufficient writing. In addition, the problem of a reduction in display quality caused by the perception of vertical lines can be solved. It is possible to relax the output capabilities (e.g., slew rate, etc.) required for a source driver, and accordingly, a drive cost can be reduced. In particular, for liquid crystal panels with OCB liquid crystal panels with OCB liquid crystal cells, the effects of preventing a reverse transition and minimizing the influence of reduction in screen luminance associated therewith are obtained. Further, even for liquid crystal cells in which the compensating voltage differs depending on colors, the optimization of the amount of black (compensating voltage) writing is made possible. The optimization of the amount of black (compensating voltage) writing can also be made possible in accordance with environmental characteristics and individual difference of a liquid crystal panel. Moreover, it is possible to supply an optimum compensating voltage for such a reverse transition prevention, for example, to a liquid crystal panel, whereby the display quality is further improved.

The invention claimed is:

1. A liquid crystal display device including a liquid crystal panel with a display region part composed of a plurality of source lines, a plurality of gate lines, and pixel cells arranged in a matrix at intersections between the source lines and the gate lines, the device comprising:

a signal conversion part for converting an input image signal at a horizontal rate, generating a non-display signal during a slack time created by the conversion, and inserting the non-display signal in a display signal, which is the converted input image signal;

a drive pulse generation part for generating various control pulses from an inputted synchronous signal;

a source driver for receiving various signals from the signal conversion part and the drive pulse generation part, converting the display signal and the non-display signal to predetermined voltage values, and outputting them as a display signal voltage and a non-display signal voltage, respectively;

a gate driver for receiving a control signal from the drive pulse generation part and supplying a drive voltage to the gate lines;

a multiplexer part for supplying to a plurality of the source lines the display signal voltage and the non-display signal voltage from the source driver while switching the source lines in a time-sharing manner, the multiplexer part being disposed between the source driver and the display region part; and an intersection part where, when the source lines in the display region part are divided into groups of four, lines that correspond to two source lines located the second and third from an end in each group intersect each other, the intersection part being present between the source driver and the display region part.

2. The liquid crystal display device according to claim 1, wherein the display signal voltages which respectively correspond to a plurality of rows of the pixels are sequentially applied to the respective source lines, within a predetermined period after the non-display signal voltage has been applied to all of the source lines.

3. The liquid crystal display device according to claim 2, wherein a polarity of the non-display signal voltage supplied to the source line is the same as a polarity of the display signal voltage supplied to the source line subsequent to the non-display signal voltage.

4. The liquid crystal display device according to claim 2, wherein a polarity of the non-display signal voltage supplied to the source line during a simultaneous selection period, in which a plurality of the gate lines are selected, is the same as a polarity of the display signal voltage supplied to the source line subsequent to the non-display signal voltage, and wherein polarities of the non-display signal voltage are opposite to each other between the source lines adjacent to each other.

5. The liquid crystal display device according to claim 1, further comprising, between the multiplexer part and the display region part, compensating voltage application means for applying a compensating voltage to the source lines, wherein the compensating voltage application means applies the compensating voltage to all the source lines within a predetermined period in synchronization with the display signal voltage outputted from the source driver.

6. The liquid crystal display device according to claim 5, wherein the display signal voltages which respectively correspond to a plurality of rows of the pixels are sequentially applied to the respective source lines, within a predetermined period after the compensating voltage has been applied to all of the source lines.

7. The liquid crystal display device according to claim 6, wherein in a period in which the compensating voltage is simultaneously applied to all the source lines, the non-display signal voltage having the same polarity as that of the display signal voltages to be supplied to the source lines subsequent to the compensating voltage is applied to the multiplexer part.

8. The liquid crystal display device according to claim 5, wherein a polarity of the compensating voltage supplied to the source line is the same as a polarity of the display signal voltage supplied to the source line subsequent to the compensating voltage.

9. The liquid crystal display device according to claim 5, wherein a polarity of the compensating voltage supplied to the source line during a simultaneous selection period, in which a plurality of the gate lines are selected, is the same as a polarity of the display signal voltage supplied to the source line subsequent to the compensating voltage, and wherein polarities of the compensating voltage are opposite to each other between the source lines adjacent to each other.

10. The liquid crystal display device according to claim 5, wherein the compensating voltage application means applies to the source lines two or more different types of compensating voltages having different voltage values.

11. The liquid crystal display device according to claim 10, wherein the voltage values of the compensating voltages are adjustable in accordance with characteristics of the liquid crystal panel.

12. The liquid crystal display device according to claim 10, wherein the source lines correspond to any one of the colors R, G, and B, and wherein the compensating voltage application means supplies to the source lines the compensating voltages having voltage values which are individually set in accordance with the colors.

13. The liquid crystal display device according to claim 5, wherein an absolute value of the compensating voltage is greater than an absolute value of the non-display signal voltage.

14. The liquid crystal display device according to claim 1, wherein the intersection part is present between the source driver and the multiplexer part.

15. The liquid crystal display device according to claim 1, wherein a liquid crystal cell is of OCB.

* * * * *